US010195713B2

(12) United States Patent
Norimoto

(10) Patent No.: US 10,195,713 B2
(45) Date of Patent: Feb. 5, 2019

(54) LAPPING PADS AND SYSTEMS AND METHODS OF MAKING AND USING THE SAME

(71) Applicant: 3M INNOVATIVE PROPERTIES COMPANY, St. Paul, MN (US)

(72) Inventor: Masahi Norimoto, Kanagawa (JP)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 176 days.

(21) Appl. No.: 15/234,720

(22) Filed: Aug. 11, 2016

(65) Prior Publication Data

US 2018/0043498 A1 Feb. 15, 2018

(51) Int. Cl.

| | |
|---|---|
| ***B24B 37/24*** | (2012.01) |
| ***B24D 3/32*** | (2006.01) |
| ***B24B 37/22*** | (2012.01) |
| ***B24B 37/015*** | (2012.01) |
| ***B24B 37/26*** | (2012.01) |

(52) U.S. Cl.

CPC ..... *B24B 37/22* (2013.01); *B24B 37/015* (2013.01); *B24B 37/24* (2013.01); *B24B 37/26* (2013.01)

(58) Field of Classification Search

CPC ..... B24B 37/20; B24B 37/22; B24B 37/24; B24D 3/346; B24D 3/32

USPC ..... 451/526, 527, 533, 41, 53; 51/297, 298

See application file for complete search history.

(56) References Cited

U.S. PATENT DOCUMENTS

| | | | | |
|---|---|---|---|---|
| 5,152,917 | A | 10/1992 | Pieper | |
| 5,435,816 | A | 7/1995 | Spurgeon | |
| 5,593,340 | A * | 1/1997 | Nelson | B24B 13/01 451/42 |
| 5,905,099 | A | 5/1999 | Everaerts | |
| 6,285,001 | B1 | 9/2001 | Fleming | |
| 6,372,323 | B1 | 4/2002 | Kobe | |
| 6,852,766 | B1 | 2/2005 | DeVoe | |
| 7,008,680 | B2 | 3/2006 | Everaerts | |

(Continued)

FOREIGN PATENT DOCUMENTS

| | | |
|---|---|---|
| JP | 2002-307297 | 10/2002 |
| JP | 2011-083856 | 4/2011 |

(Continued)

OTHER PUBLICATIONS

International Search Report for PCT International Application No. PCT/IB2017/054861 dated Nov. 23, 2017, 4 pages.

*Primary Examiner* — Robert Rose

(74) *Attorney, Agent, or Firm* — Adam Bramwell; Jeffrey S. Kollodge

(57) ABSTRACT

The present disclosure relates to lapping pads which include an abrading layer, wherein the abrading layer includes a working surface and a second surface opposite the working surface having a projected area Ap, and at least one cavity having a cavity opening located at the second surface, the at least one cavity being defined by at least one rib, each rib having a distal end at the second surface; and a phase transition material having a thermally reversible phase transition, wherein the phase transition material is disposed in the at least one cavity. The present disclosure further relates to a lapping system, the lapping system includes a lapping pad of the present disclosure and a working fluid; a method of making a lapping pad; and a method of lapping using a lapping pad of the present disclosure.

23 Claims, 4 Drawing Sheets

(56) References Cited

U.S. PATENT DOCUMENTS

| | | | |
|---|---|---|---|
| 7,091,255 | B2 | 8/2006 | DeVoe |
| 7,169,031 | B1 | 1/2007 | Fletcher |
| 7,494,519 | B2 | 2/2009 | Fletcher |
| 7,594,845 | B2 | 9/2009 | Lugg |
| 8,361,632 | B2 | 1/2013 | Everaerts |
| 8,361,633 | B2 | 1/2013 | Everaerts |
| 9,238,294 | B2 | 1/2016 | Lefevre |
| 9,296,085 | B2 | 3/2016 | Bajaj |
| 2003/0203708 | A1 | 10/2003 | Liu |
| 2007/0093181 | A1 | 4/2007 | Lugg |
| 2009/0087629 | A1 | 4/2009 | Everaerts |
| 2010/0040842 | A1 | 2/2010 | Everaerts |
| 2010/0136265 | A1 | 6/2010 | Everaerts |
| 2010/0188751 | A1 | 7/2010 | Clarke |
| 2012/0325402 | A1 | 12/2012 | Suwa |
| 2016/0101500 | A1 | 4/2016 | Fung |

FOREIGN PATENT DOCUMENTS

| | | |
|---|---|---|
| KR | 2010-0073536 | 7/2010 |
| WO | WO 2012-112856 | 8/2012 |
| WO | WO 2015-047939 | 4/2015 |

* cited by examiner

LAPPING PADS AND SYSTEMS AND METHODS OF MAKING AND USING THE SAME

FIELD

The present disclosure relates to lapping pads and systems useful for the lapping of substrates, and methods of making and using such lapping pads.

BACKGROUND

Various abrasive articles and methods for the lapping of substrates, e.g. hard substrates, have been disclosed in the art. Such articles and methods are described in, for example, U.S. Pat. Nos. 7,169,031, 7,494,519 and 7,594,845. Lapping is a grinding process that typically involves a slurry of loose abrasive grits, such as aluminum oxide in a liquid, flowed across a rotating lap plate, typically a metal such as cast iron. This provides an abrasive film between the polishing pad and the workpiece that enables stock removal from a single side or from both sides simultaneously. Lapping may also be conducted using fixed abrasive pads, often in combination with a liquid coolant or lubricant to facilitate the lapping process.

SUMMARY

In one embodiment, the present disclosure provides a lapping pad comprising:

an abrading layer, wherein the abrading layer has a working surface, a second surface opposite the working surface having a projected area Ap, and at least one cavity having a cavity opening located at the second surface, the at least one cavity being defined by at least one rib, each rib having a distal end at the second surface; and a phase transition material having a thermally reversible phase transition, wherein the phase transition material is disposed in the at least one cavity; and wherein the total area of the cavity opening of the at least one cavity is between about 0.05Ap and about 0.995AP.

In some embodiments, the lapping pad further comprises a sealing layer in contact with at least a portion of the second surface of the abrading layer.

In some embodiments, the at least one cavity is a plurality of cavities and, optionally, the plurality of cavities having an areal density of between about 1 cavity/100 $cm^2$ of area Ap to about 5000 cavities/1 $cm^2$ of area Ap.

In some embodiments, the lapping pad contains less than 5 percent by weight inorganic particles.

In some embodiments, the lapping pad contains less than 5 percent by weight inorganic abrasive particles having a mohs hardness of seven or greater.

In another embodiment, the present disclosure provides method of making a lapping pad comprising:

providing an abrading layer, wherein the abrading layer has a working surface, a second surface opposite the working surface having a projected area Ap, and at least one cavity having a cavity opening located at the second surface, the at least one cavity being defined by at least one rib, each rib having a distal end at the second surface, wherein the total area of the cavity opening of the at least one cavity is between about 0.05Ap and about 0.995AP;

providing a phase transition material having a thermally reversible phase transition;

disposing the phase transition material in the at least one cavity.

In some embodiments, the method of making a lapping pad further comprises the step of removing phase transition material from at least a portion of the distal end of the at least one rib.

In some embodiments, the method of making a lapping pad further comprises the step of providing a sealing layer and laminating the sealing layer to at least a portion of the second surface of the abrading layer.

In another embodiment, the present disclosure provides a lapping system comprising a lapping pad according to any one of the lapping pads of the present disclosure and a working fluid. In some embodiments, the working fluid may be a slurry.

In another embodiment, the present disclosure provides method of lapping a substrate comprising:

providing a lapping pad according to any one of the lapping pads of the present disclosure;

providing a substrate;

contacting the working surface of the lapping pad with the substrate surface;

moving the lapping pad and the substrate relative to one another while maintaining contact between the working surface of the lapping pad and the substrate surface; and wherein lapping is conducted in the presence of a working fluid.

BRIEF DESCRIPTION OF THE DRAWING

The disclosure may be more completely understood in consideration of the following detailed description of various embodiments of the disclosure in connection with the accompanying figures, in which.

DEFINITIONS

Figure 1A:
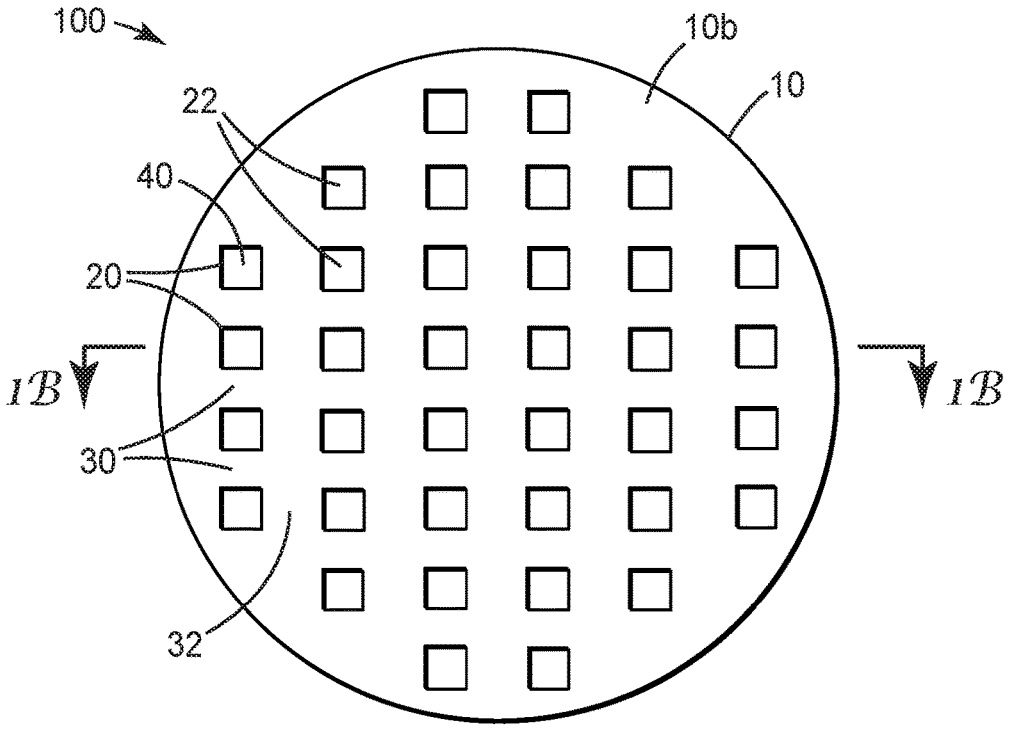
FIG. 1A is a schematic top view of a lapping pad according to one exemplary embodiment of the present disclosure.

Repeated use of reference characters in the specification and drawings is intended to represent the same or analogous features or elements of the disclosure. The drawings may not be drawn to scale. As used herein, the word "between", as applied to numerical ranges, includes the endpoints of the ranges, unless otherwise specified. The recitation of numerical ranges by endpoints includes all numbers within that range (e.g. 1 to 5 includes 1, 1.5, 2, 2.75, 3, 3.80, 4, and 5)

and any range within that range. Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

It should be understood that numerous other modifications and embodiments can be devised by those skilled in the art, which fall within the scope and spirit of the principles of the disclosure. All scientific and technical terms used herein have meanings commonly used in the art unless otherwise specified. The definitions provided herein are to facilitate understanding of certain terms used frequently herein and are not meant to limit the scope of the present disclosure. As used in this specification and the appended claims, the singular forms "a", "an", and "the" encompass embodiments having plural referents, unless the context clearly dictates otherwise. As used in this specification and the appended claims, the term "or" is generally employed in its sense including "and/or" unless the context clearly dictates otherwise.

Throughout this disclosure, when a surface of one substrate is in "contact" with the surface of another substrate, there are no intervening layer(s) between the two substrates and at least a portion of the surfaces of the two substrates are in physical contact.

Throughout this disclosure, if a layer or a surface of a layer is "adjacent" to a second layer or a surface of a second layer, the two nearest surfaces of the two layers are considered to be facing one another. They may be in contact with one another or they may not be in contact with one another, an intervening third layer(s) or substrate(s) being disposed between them.

Throughout this disclosure, "working surface" refers to the surface of an abrading layer that is designed to be adjacent to and in at least partial contact with the surface of the substrate being abraded.

Throughout this disclosure, "cavity" refers to a void in the surface of a layer that allows a material, e.g. a liquid and/or solid, to be contained therein, e.g. a liquid can be contained in and not flow out of a cavity.

Throughout this disclosure, "precisely shaped" refers to a topographical feature, e.g. a cavity or asperity, having a molded shape that is the inverse shape of a corresponding mold cavity or mold protrusion, said shape being retained after the topographical feature is removed from the mold; and/or a topographical feature formed by machining a surface, i.e. cutting of a surface. A cavity formed through a foaming process or removal of a soluble material (e.g. a water soluble particle) from a polymer matrix, is not a precisely shaped cavity.

Throughout this disclosure, "micro-replication" refers to a fabrication technique wherein precisely shaped topographical features are prepared by casting or molding a polymer (or polymer precursor that is later cured to form a polymer) in a production tool, e.g. a mold or embossing tool, wherein the production tool has a plurality of micron sized to millimeter sized topographical features. Upon removing the polymer from the production tool, a series of topographical features are present in the surface of the polymer. The topographical features of the polymer surface have the inverse shape as the features of the original production tool. The micro-replication fabrication techniques disclosed herein inherently result in the formation of a micro-replicated layer, i.e. an abrading layer, which may include micro-replicated asperities on its working surface, i.e. precisely shaped asperities, when the production tool has cavities; and micro-replicated cavities, i.e. precisely shaped cavities, when the production tool has protrusions. If two unique production tool are used, one that includes protrusions and one that includes cavities, the micro-replicated layer, e.g. abrading layer, may have both micro-replicated asperities, e.g. precisely shaped asperities on the working surface for example, and micro-replicated cavities, e.g. precisely shaped cavities on the second surface opposite the working surface.

DETAILED DESCRIPTION

Various materials are used for the lapping and polishing of substrates including fixed abrasives, e.g. a fixed abrasive pad which may be used in conjunction with a cooling fluid, and abrasive free pads, which are typically used in conjunction with an abrasive containing slurry. During the lapping of hard substrates, e.g. sapphire, the high pressures, high rotational speeds of the lapping plate/pad and/or aggressive abrasives used can lead to the generation of a significant amount of heat. When the lapping plate/pad has high thermal conductivity, for example when the lapping plate is a copper plate, the high thermal conductivity of the metal may be capable of removing heat at a sufficient rate, thereby preventing significant heat build-up in the lapping plate and/or substrate being lapped. More recently, lapping pads based on polymer materials have been developed to replace metal lapping plates and have been used in combination with abrasive slurries. Polymer based lapping pads have several advantage over traditional metal lapping plates, including lower material cost and easier handling due in part to their lighter weight. However, due to the polymer's low thermal conductivity, heat generation from the lapping process can lead to significant temperature increase in the lapping pad and/or substrate being lapped. This temperature rise is undesirable, as it can change the mechanical properties of the lapping pad and subsequently alter its lapping performance. Thus, there is a need to develop polymer based lapping pads that provide improved thermal characteristics, e.g. improved thermal conductivity, in order to provide a more stable lapping process. Although not wishing to be bound by theory, it is though that the mechanistic aspects of the invention enable its use in lapping pads made of a wide variety of materials, and the invention is not limited to polymer lapping pads, but may be particularly beneficial to polymer lapping pads, due to the, generally, low thermal conductivities of polymers.

The present invention provides a lapping pad having a working surface and a second surface, and at least one cavity, having a cavity opening located at the second surface. A phase transition material having a thermally reversible phase transition is disposed in the at least one cavity. The lapping pads of the present disclosure may have improve thermal characteristics, e.g. thermal conductivity. The phase transition material is selected such that the phase transition temperature is in the range of the targeted lapping temperature or maximum target lapping temperature. During lapping, as the temperature of the lapping pad increases due to heating, e.g. frictional heating, as a result of the lapping process, the lapping pad will reach the phase transition temperature of the phase transition material. At this point, the phase transition material will go through its phase transition. It is well known that the enthalpy of a phase transition, e.g. melting point transition, can be quite large. At the phase transition temperature, the phase transition material absorbs energy in the form of heat from the lapping process, goes through its phase transition at its phase transition temperature and thereby minimizes the temperature increase of the lapping pad. The heat absorbed by the phase transition material can then be removed from the lapping pad, for example through the platen the pad is mounted to (particularly a cooled platen), thereby causing the phase transition material to go through the reverse phase transition. This process can be repeated indefinitely during the lapping process, thereby limiting the temperature rise of the lapping pad. By selecting a phase transition material with the desire phase transition temperature, one can selectively tune the lapping temperature or limit the temperature rise of the lapping pad so that lapping is maintain at, near or below the desire temperature.

Although lapping pads are described throughout this disclosure and generally relate to abrading process that remove large amounts of material from the substrate being lapped, similar thermal effects can be seen in polishing applications, where lower amounts of material removal from the substrate are observed. In the present disclosure, the term "lapping" is meant to include both lapping and polishing type abrading applications and the term "lapping" is not meant to limit the scope of the invention based on material removal rate from the substrate being lapped or polished, surface finish of the substrate being lapped or polished and/or abrasive particle size employed in the lapping or polishing process.

In one embodiment, the present disclosure provides a lapping pad including an abrading layer, wherein the abrading layer has a working surface, a second surface opposite the working surface having a projected area Ap, and at least one cavity having a cavity opening located at the second surface, the at least one cavity being defined by at least one rib, each rib having a distal end at the second surface; and a phase transition material having a thermally reversible phase transition, wherein the phase transition material is disposed in the at least one cavity. In some embodiments, the total area of the cavity opening of the at least one cavity is between about 0.05Ap and about 0.995AP. The lapping pad may be a polymer lapping pad. In some embodiments, the polymer lapping pad is from about 30 percent to about 100 percent by weight polymer. In some embodiments, the at least one cavity is precisely shaped. In some embodiments, the at least one cavity is a plurality of cavities and, optionally, the plurality of cavities having an areal density of between about 1 cavity/100 $cm^2$ of area Ap to about 5000 cavities/1 $cm^2$ of area Ap. In some embodiments, the plurality of cavities are precisely shaped. The thermally reversible phase transition may be at least one of a melting point transition, a crystal to crystal transition, a liquid crystal to liquid crystal transition, and a boiling point transition. In some embodiments, the phase transient material may have a melting point between about 5° C. and about 80° C. In some embodiments, the phase transition material has a molecular weight of between about 100 g/mol and about 3000 g/mol. In some embodiments, the phase transition material has a heat of fusion between about 100 J/g and about 400 J/g. In some embodiments, the lapping pad contains less than 5 percent by weight inorganic material. In some embodiments, the lapping pad contains less than 5 percent by weight abrasive particles having a mohs hardness of seven or greater. In some embodiments, the lapping pad may include a sealing layer in contact with at least a portion of the second surface of the abrading layer.

Figure 1B:
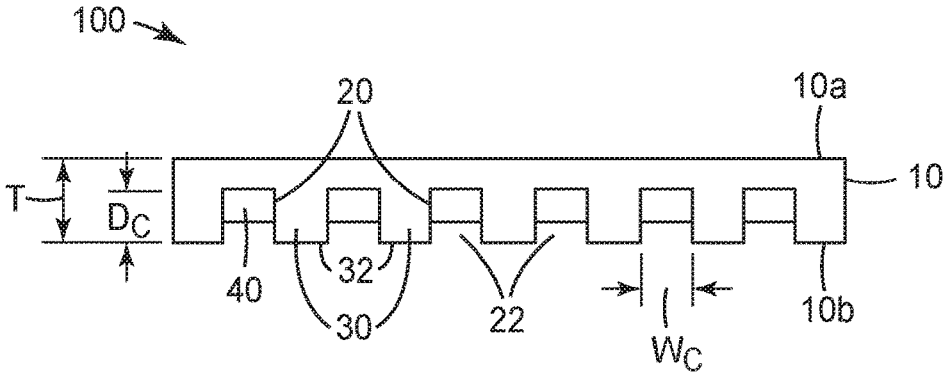
FIG. 1B is a schematic cross-sectional diagram of the lapping pad of FIG. 1A, through line A-A, according to one exemplary embodiment of the present disclosure.

FIG. 1A is a schematic top view of a lapping and FIG. 1B is a schematic cross-sectional diagram of the lapping pad of FIG. 1A, through line A-A, according to one exemplary embodiment of the present disclosure. FIGS. 1A and 1B show lapping pad 100. In this exemplary embodiment, lapping pad 100 is circular in shape and includes an abrading layer 10 having a working surface 10*a* and a second surface 10*b* opposite the working surface. Working surface 10*a* is shown to be a substantially flat surface with no included abrading features. Second surface 10*b* has a projected surface area, Ap, which would correspond to the area of the circle (pi times the radius squared) of the circular shaped lapping pad, shown in FIG. 1A. Lapping pad 100 further includes at least one cavity 20, in this exemplary embodiment, a plurality of cavities (a plurality of discrete cavities), the cavities having a square shape relative to the plane of surface 10*b*. The at least one cavity 20 has an opening 22 located at the second surface. In some embodiments, the total area of the cavity opening 22 of the at least one cavity 20 is between about 0.05Ap and about 0.995A. In this exemplary embodiment, the total area of the at least one cavity would be the total area of the plurality of cavities, i.e. the sum of the areas of square shaped cavities 20. The at least one cavity is defined by at least one rib 30, each rib 30 has a distal end 32 at the second surface 10*b*. The exterior surface of the distal end 32 of the at least one rib defines the second surface 10*b*. In this exemplary embodiment, rib 30 is a single rib, i.e. a single continuous rib (as opposed to a plurality of discrete ribs), that define the plurality of cavities. Lapping pad 100 further includes a phase transition material 40 having a thermally reversible phase transition disposed in the at least one cavity 20. In this exemplary embodiment, which includes a plurality of cavities, phase transition material 40 is disposed in all the cavities, partially filling each cavity. In any of the lapping pads of the present disclosure, the phase transition material may partially fill the at least one cavity or it may completely fill the at least one cavity. In any of the lapping pads of the present disclosure, when a plurality of cavities are used, the phase transition material may partially fill at least a portion of the plurality of cavities, may completely fill at least a portion of the plurality of cavities or combination thereof (a portion of the cavities may be completely full and a portion of the cavities may be partially full). In some embodiments, when the lapping pad includes a plurality of cavities, the phase transition material may partially fill, may completely fill or combination thereof at least 30 percent, at least 50 percent, at least 70 percent, at least 90 percent, at least 95 percent, at least 99 percent or even at least 100 percent of the plurality of cavities. The thickness of the abrading layer is T, the width of a cavity is We and the depth of a cavity is Dc.

Figure 2A:
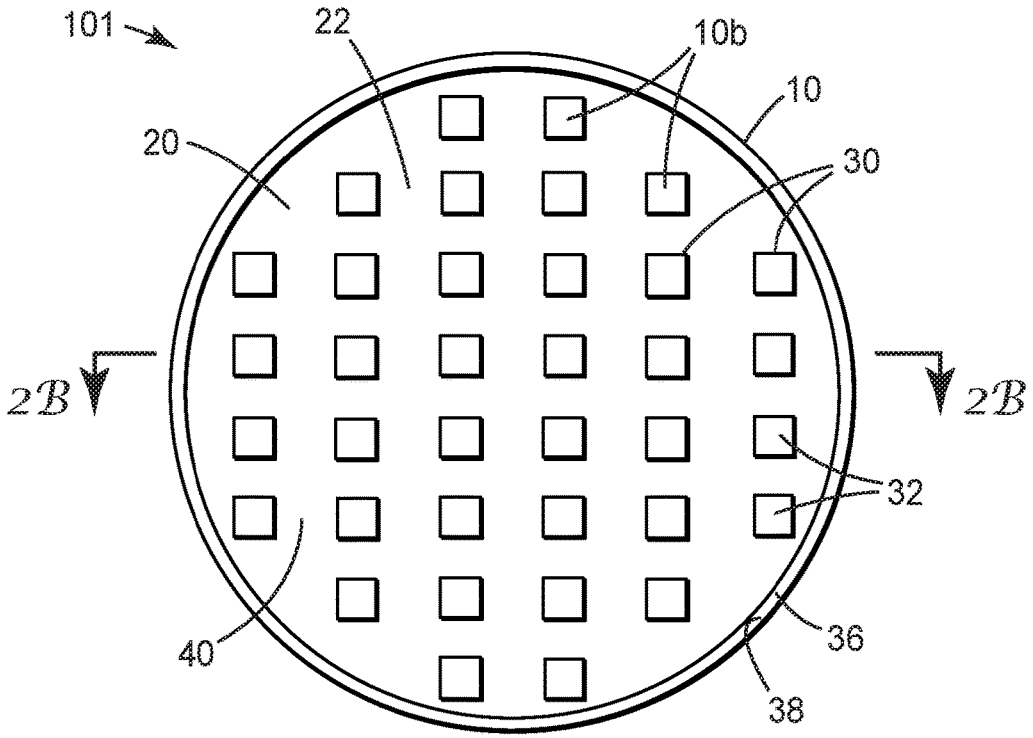
FIG. 2A is a schematic top view of a lapping pad according to one exemplary embodiment of the present disclosure.
Figure 2B:
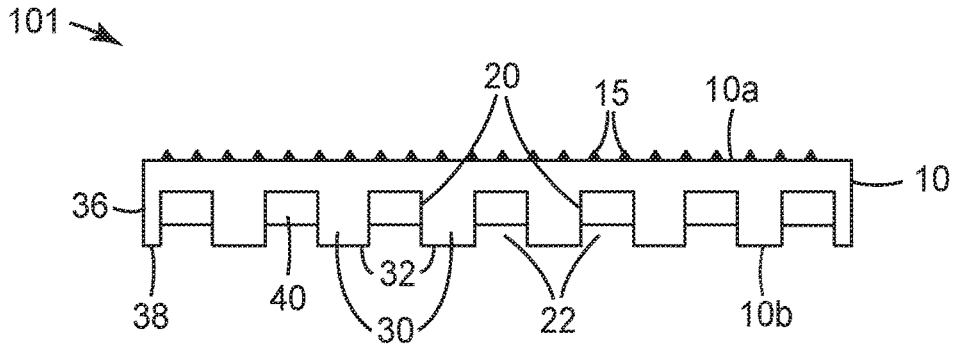
FIG. 2B is a schematic cross-sectional diagram of the lapping pad of FIG. 2A, through line B-B, according to one exemplary embodiment of the present disclosure.

FIG. 2A is a schematic top view of a lapping and FIG. 2B is a schematic cross-sectional diagram of the lapping pad of FIG. 2A, through line B-B, according to one exemplary embodiment of the present disclosure. FIGS. 2A and 2B show lapping pad 101. In this exemplary embodiment, lapping pad 101 is circular in shape and includes an abrading layer 10 having a working surface 10*a* and a second surface 10*b* opposite the working surface. Second surface 10*b* has a projected surface area, Ap, which would correspond to the area of the circle (pi times the radius squared) of the circular shaped lapping pad, shown in FIG. 2A. Lapping pad 101 further includes at least one cavity 20, in this exemplary embodiment, a single cavity, i.e. a continuous cavity (as opposed to a plurality of discrete cavities) the cavities encompassing the region between the ribs and extending to the circumference of the circular pad. The at least one cavity

20 has an opening 22 located at the second surface. In some embodiments, the total area of the cavity opening 22 (the sum of the area of all individual cavity openings) of the at least one cavity 20 is between about 0.05Ap and about 0.995A. The at least one cavity is defined by at least one rib 30, each rib 30 has a distal end 32 at the second surface 10*b*. The exterior surface of the distal end 32 of the at least one rib defines the second surface 10*b*. In this exemplary embodiment, the at least one rib 30 is a plurality of ribs (a plurality of discrete ribs), the ribs having a square shape relative to the plane of surface 10*b*. Lapping pad 100 further includes a phase transition material 40 having a thermally reversible phase transition disposed in the at least one cavity 20. In this exemplary embodiment which includes a single cavity, phase transition material 40 is disposed throughout the entire cavity region (with respect to area Ap), partially filling the cavity. Lapping pad 101, optionally, may include at least one containment rib 36 which is located near or along the circumference of lapping pad 101. Containment rib 36 includes distal end 38, which is considered to be part of second surface 10*b*. Containment rib 36 may be required to contain phase transition material 40 in the at least one cavity 20, once the phase transition material has been elevated in temperature at or above its phase transition temperature. For example, if the phase transition material has a low molecular weight and has a melting point transition, upon melting, the phase transition material may readily flow and containment rib 36 may be required to contain the liquid phase transition material within lapping pad 101. In other embodiments, for example if the phase transition material is a polymer having a melting point transition, the high viscosity of the polymer may inhibit flow and containment rib 36 may not be required. One or more containment ribs may be used. In this exemplary embodiment, the total area of the at least one cavity 20 would be the area AP minus the total surface area of the plurality of ribs, i.e. the sum of the areas of square shaped ribs 30 and, if present, minus the surface area of the distal end 38 of containment rib 36 (the surface area of containment rib 36 which is part of second surface 10*b*). In this exemplary embodiment, working surface 10*a* includes asperities 15. Asperities 15 may be engineered asperities that are specifically designed into lapping pad 101 during fabrication, e.g. asperities 15 may be formed by an embossing or machining process or asperities 15 may be formed during or prior to the lapping process via the use of a pad conditioner. Any of the lapping pads of the present disclosure may include an abrading layer 10 having a working surface 10*a* which includes asperities 15. Asperities 15 may be precisely shaped asperities. Precisely shaped asperities are known in the art an may be fabricated by micro-replication techniques, for example. The asperities may be uniformly distributed across working surface 10*a*. With respect to the size of the asperities, in some embodiments, at least one dimension, e.g. height, width and/or length, may be between about 0.02 mm and about 10 mm, between about 0.05 mm and 7 mm, or even between about 0.1 mm and about 4 mm.

The abrading layer is not particularly limited and may be a fixed abrasive abrading layer or an abrasive free abrading layer. During use, the fixed abrasive abrading layer may be used alone, e.g. without the use of a liquid coolant. During use, the fixed abrasive abrading layer may be used in conjunction with an abrasive free coolant/lubricant, or in conjunction with an abrasive containing slurry, the former being of particular utility. In use, an abrasive free abrading layer may be used in conjunction with an abrasive free coolant/lubricant or in conjunction with an abrasive containing slurry, the latter being of particular utility. In some embodiments, the abrading layer includes polymer. The type of polymer is not particularly limited and may include any known polymer, including thermoplastics (thermoplastics including thermoplastic elastomers (TPEs), e.g. TPEs based on block copolymers), thermosets, e.g. elastomers, and combinations thereof. If an embossing process is being used to fabricate the abrading layer, thermoplastics are generally utilized for the abrading layer. Thermoplastics include, but are not limited to polyurethanes; polyalkylenes, e.g. polyethylene and polypropylene; polybutadiene, polyisoprene; polyalkylene oxides, e.g. polyethylene oxide; polyesters; polyamides; polycarbonates, polystyrenes, polysulphones, polyphenylene oxides, partially and fully halogenated thermoplastics, e.g. polyvinyl chloride and polyvinylidene fluoride, polyacrylates, polymethacrylates, block copolymers of any of the proceeding polymers, and the like, including combinations thereof. Polymer blends may also be employed. Thermosets include, but are not limited to, epoxy resin, phenolic resin, polyurethane, urea-formaldehyde resin, melamine resin, polyacrylate and poly(meth)acrylate and combinations thereof. In some embodiments, the abrading layer may be from about 30 percent to about 100 percent, from about 50 percent to about 100 percent, from about 65 percent to about 100 percent, from about 80 percent to about 100 percent, from about 90 percent to about 100 percent, or even from about 95 percent to about 100 percent by weight polymer.

In some embodiments, the abrading layer may be a unitary sheet. A unitary sheet includes only a single layer of material (i.e. it is not a multi-layer construction, e.g. a laminate) and the single layer of material has a single composition. The composition may include multiple-components, e.g. a polymer blend or a polymer-inorganic composite. Use of a unitary sheet as the abrading layer may provide cost benefits, due to minimization of the number of process steps required to form the abrading layer. An abrading layer that includes a unitary sheet may be fabricated from techniques know in the art, including, but not limited to, molding and embossing. Due to the ability to form an abrading layer having precisely shaped cavities in a single step, a unitary sheet is preferred.

The hardness and flexibility of abrading layer is predominately controlled by the material, e.g. polymer, used to fabricate it. The hardness of abrading layer is not particularly limited. The hardness of the abrading layer may be greater than about 20 Shore D, greater than about 30 Shore D or even greater than about 40 Shore D. The hardness of abrading layer may be less than about 90 Shore D, less than about 80 Shore D or even less than about 70 Shore D. The hardness of abrading layer may be greater than about 20 Shore A, greater than about 30 Shore A or even greater than about 40 Shore A. The hardness of abrading layer may be less than about 95 Shore A, less than about 80 Shore A or even less than about 70 Shore A. The abrading layer may be flexible. In some embodiments the abrading layer is capable of being bent back upon itself producing a radius of curvature in the bend region of less than about 10 cm, less than about 5 cm, less than about 3 cm, or even less than about 1 cm; and greater than about 0.1 mm, greater than about, 0.5 mm or even greater than about 1 mm. In some embodiments, the abrading layer is capable of being bent back upon itself producing a radius of curvature in the bend region of between about 10 cm and about 0.1 mm, between about 5 cm and bout 0.5 mm or even between about 3 cm and about 1 mm.

To improve the useful life of abrading layer 10, it is desirable to utilize polymeric materials having a high degree of toughness. The use life may be determined by the specific process in which the abrading layer is employed. In some embodiments, the use life time is at least about 30 minutes at least 60 minutes, at least 100 minute, at least 200 minutes, at least 500 minutes or even at least 1000 minutes. The use life may be less than 10000 minutes, less than 5000 minutes or even less than 2000 minutes. The useful life time may be determined by measuring a final parameter with respect to the end use process and/or substrate being polished. For example, use life may be determined by having an average removal rate or having a removal rate consistency (as measure by the standard deviation of the removal rate) of the substrate being polished over a specified time period (as defined above) or producing a consistent surface finish on a substrate over a specified time period. In some embodiments, the abrading layer can provide a standard deviation of the removal rate of a substrate being polished that is between about 0.1% and 20%, between about 0.1% and about 15%, between about 0.1% and about 10%, between about 0.1% and about 5% or even between about 0.1% and about 3% over a time period from of, at least about 30 minutes, at least about 60 minutes, at least about 100 minutes at least about 200 minutes or even at least about 500 minutes. The time period may be less than 10000 minutes. To achieve this, it is desirable to use polymeric materials having a high work to failure (also known as Energy to Break Stress), as demonstrated by having a large integrated area under a stress vs. strain curve, as measured via a typical tensile test, e.g. as outlined by ASTM D638. High work to failure may correlate to lower wear materials. In some embodiments, the abrading layer may include a polymer having a work to failure greater than about 3 Joules, greater than about 5 Joules, greater than about 10 Joules, greater than about 15 joules greater than about 20 Joules, greater than about 25 Joules or even greater than about 30 Joules. The work to failure may be less than about 100 Joules or even less than about 80 Joules.

The polymer used to fabricate abrading layer may be used in substantially pure form. The polymer used to fabricate abrading layer may include fillers known in the art. In some embodiments, the abrading layer is substantially free of inorganic material. By substantially free of inorganic material it is meant that the abrading layer includes less than about 10% by weight, less than about 5% by weight, less than about 3% by weight, less than about 1% by weight or even less than about 0.5% by weight inorganic material. In some embodiments, the abrading layer is substantially free of any inorganic abrasive material (e.g. inorganic abrasive particles), i.e. it is an abrasive free abrading layer. By substantially free it is meant that the abrading layer includes less than about 10% by weight, less than about 5% by weight, less than about 3% by weight, less than about 1% by weight or even less than about 0.5% by weight inorganic abrasive particles. In some embodiments, the abrading layer contains substantially no inorganic abrasive particles. An abrasive material may be defined as a material having a Mohs hardness greater than the Mohs hardness of the substrate being abraded or polished. An abrasive material may be defined as having a Mohs hardness greater than about 5.0, greater than about 5.5, greater than about 6.0, greater than about 6.5, greater than about 7.0, greater than about 7.5, greater than about 8.0 or even greater than about 9.0. The maximum Mohs hardness is general accepted to be about 10.

The abrading layer may be fabricated by any techniques known in the art. The abrading layer and its corresponding topography, i.e. the at least one cavity, may be formed by a variety of techniques including, but not limited to, embossing, molding (embossing and molding may include micro-replication techniques) and machining. Micro-replication techniques may offer particular utility. Micro-replication techniques are disclosed in U.S. Pat. Nos. 6,285,001; 6,372,323; 5,152,917; 5,435,816; 6,852,766; 7,091,255 and U.S. Patent Application Publication No. 2010/0188751, for example, all of which are incorporated herein by reference in their entirety. The techniques used to fabricate the abrading layer and its corresponding topography, generally lead to precisely shaped topography, i.e. the at least one cavity is precisely shaped. In some embodiments, the at least one cavity is a precisely shaped cavity. In some embodiments, when a plurality of cavities are used, the plurality of cavities are precisely shaped cavities. The at least one cavity of the abrading layer may be formed by machine techniques, including but not limited to, traditional machining, e.g. sawing, boring, drilling, turning and the like; laser cutting; water jet cutting and the like.

In some embodiments, the abrading layer is formed by the following process. First, a sheet of polycarbonate is laser ablated according to the procedures described in U.S. Pat. No. 6,285,001, which is incorporated herein by reference in its entirety, forming the positive master tool, i.e. a tool having about the same surface topography, e.g. at least one cavity, as that required for abrading layer. The polycarbonate master is then plated with nickel using conventional techniques forming a negative master tool. The nickel negative master tool may then be used in an embossing process, for example, the process described in U.S. Patent Application Publication No. 2010/0188751, which is incorporated herein by reference in its entirety, to form the abrading layer. The embossing process may include the extrusion of a thermoplastic or TPE melt onto the surface of the nickel negative and, with appropriate pressure, the polymer melt is forced into the topographical features of the nickel negative. Upon cooling the polymer melt, the solid polymer film may be removed from the nickel negative, forming the abrading layer with a working surface and a second surface having the desired cavity or plurality of cavities (see FIGS. 1A, 1B and FIGS. 2A, 2B).

The size of the plurality of cavities of the abrading layer is not particularly limited. However, as the cavity is intended to contain the phase transition material, the cavity is not a through-hole that allows fluid communication between the working surface and second surface of the abrading layer.

The shape of the at least one cavity is not particularly limited and includes, but is not limited to, cylinders, half spheres, cubes, rectangular prism, triangular prism, hexagonal prism, triangular pyramid, 4, 5 and 6-sided pyramids, truncated pyramids, cones, truncated cones and the like. The shape of the at least one cavity may be a series of intersecting channels that form a grid array, for example a square grid array. The lowest point at the base of a cavity, relative to the cavity opening, is considered to be the bottom of the cavity. The height of a cavity is measured from this point to the cavity opening. When the abrading layer includes a plurality of cavities, the shape of the cavities may all be the same or combinations may be used. In some embodiments, at least about 10%, at least about 30%, at least about 50%, at least about 70%, at least about 90%, at least about 95%, at least about 97%, at least about 99% or even at least about 100% of the cavities are designed to have the same shape and dimensions. Due to the precision fabrication processes that may be used to fabricate the cavities, the tolerances are, generally, small. For a plurality cavities designed to have the same cavity dimensions, the cavity dimensions are uniform. In some embodiments, the percent non-uniformity of at least one distance dimension corresponding to the size of the plurality of cavities; e.g. height, width of a cavity opening, length, and diameter; is less than about 20%, less than about 15%, less than about 10%, less than about 8%, less than about 6% less than about 4%, less than about 3%, less than about 2%, less than about 1.5%, or even less than about 1%. The percent non-uniformity is the standard deviation of a set of values divided by the average of the set of values multiplied by 100. The standard deviation and average can be measured by known statistical techniques. The standard deviation may be calculated from a sample size of at least 10 cavities, at least 15 cavities or even at least 20 cavities. The sample size may be no greater than 200 cavities, no greater than 100 cavities or even no greater than 50 cavities. The sample may be selected randomly from a single region on the abrading layer or from multiple regions of the abrading layer.

In some embodiments, the longest dimension of the cavity opening of the at least one cavity, e.g. the diameter when the cavities are discrete cavities cylindrical in shape, may be less than about 10 mm, less than about 5 mm, less than about 1 mm, less than about 500 microns, less than about 200 microns, less than about 100 microns, less than about 90 microns, less than about 80 microns, less than about 70 microns or even less than about 60 microns. In some embodiments, the longest dimension of the cavity opening may be greater than about 1 micron, greater than about 5 microns, greater than about 10 microns, greater than about 15 microns or even greater than about 20 microns. The cross-sectional area of the cavity, e.g. a circle when the cavities are cylindrical in shape, may be uniform throughout the depth of the cavity, or may decrease, if the cavity sidewalls taper inward from opening to base, or may increase, if the cavity sidewalls taper outward from opening to base. The cavity openings may all have about the same longest dimensions or the longest dimension may vary between cavity openings or between sets of different cavity openings, per design. The cavities may be a series of parallel channels that span about the entire width of the polishing pad. The width, Wc, of the cavity opening may be equal to the values give for the longest dimension, described above.

The depth of the at least one cavity, Dc, is only limited by the thickness of the abrading layer, T, with Dc<T. This enables the cavity to contain the phase transition material. Although the depth of the at least one cavity is limited as indicated above, this does not prevent the inclusion of one or more other through-holes in the lapping pad, e.g. through-holes to provide, for example, slurry solution up through the lapping pad to the working surface or a path for airflow through the pad. A through-hole may be defined as a hole going through the entire thickness, T, of the abrading layer. If the lapping pad includes a sealing layer, the through-hole may also go through the sealing layer and subsequently through the entire thickness of the lapping pad. The depth of the at least one cavity may be the same or may vary across the lapping pad. If a plurality of cavities are used, the cavities may all be about the same depth or may vary in depth.

The thickness of the abrading layer, which limits the depth of the at least one cavity, may be between about 0.5 mm and about 20 mm, between about 0.5 mm and about 20 mm, between about 0.5 mm and about 15 mm, between about 0.5 mm and about 10 mm, between about 0.5 mm and about 8 mm, between about 0.5 mm and about 5 mm, between about 1 mm and about 20 mm, between about 1 mm and about 20 mm, between about 1 mm and about 15 mm, between about 1 mm and about 10 mm, between about 1 mm and about 8 mm, between about 1 mm and about 5 mm, between about 2 mm and about 20 mm, between about 2 mm and about 20 mm, between about 2 mm and about 15 mm, between about 2 mm and about 10 mm, between about 2 mm and about 8 mm, or even between about 2 mm and about 5 mm.

The volume of the at least one cavity depends on the dimensions of the at least one cavity. The greater the total volume of the at least one cavity (the sum of the volumes of the individual cavities, if a plurality of cavities are used), the greater amount of phase transition material that can be contained in the abrading layer and subsequently the lapping pad. In general, higher amounts of phase transition material contained in the abrading layer should lead to improved thermal stability of the lapping pad. In some embodiments the ratio of the volume of the at least one cavity (the sum of the volumes of the individual cavities, if a plurality of cavities are used) to the volume of the abrading layer (Ap×T) is between about 0.05 and about 0.98, between about 0.05 and about 0.95, between about 0.05 and about 0.90, between about 0.05 and about 0.80, between about 0.05 and about 0.70, between about 0.05 and about 0.60, between about 0.10 and about 0.98, between about 0.10 and about 0.95, between about 0.10 and about 0.90, between about 0.10 and about 0.80, between about 0.10 and about 0.70, between about 0.10 and about 0.60, between about 0.20 and about 0.98, between about 0.20 and about 0.95, between about 0.20 and about 0.90, between about 0.20 and about 0.80, between about 0.20 and about 0.70, or even between about 0.20 and about 0.60. If the working surface of the abrading layer includes asperities, e.g. asperities 15 of FIG. 2B, the volume of the asperities is not include in the calculation of the volume of the abrading layer. The total volume of the at least one cavity depends on the total area of the cavity opening of the at least one cavity (the sum of the areas of the individual cavity openings, if a plurality of cavities are used). Increasing the total area of the at least one cavity opening may allow more phase transition material to be contained in the abrading layer. Additionally, increasing the total area of the at least one cavity opening may improve heat transfer between the phase transition material and the platen the lapping pad is attached to, leading to improved thermal stability of the abrading layer and lapping pad. In some embodiments, the total area of the cavity opening of the at least one cavity is between about 0.05Ap and about 0.995AP, between about 0.10Ap and about 0.995Ap, between about 0.20Ap and about 0.995Ap, between about 0.30Ap and about 0.995Ap, between about 0.05Ap and about 0.95Ap, between about 0.10Ap and about 0.95Ap, between about 0.20Ap and about 0.95Ap, between about 0.30Ap and about 0.95Ap, between about 0.05Ap and about 0.90Ap, between about 0.10Ap and about 0.90Ap, between about 0.20Ap and about 0.90Ap, between about 0.30Ap and about 0.90Ap, between about 0.05Ap and about 0.80Ap, between about 0.10Ap and about 0.80Ap, between about 0.20Ap and about 0.80Ap, between about 0.30Ap and about 0.80Ap, between about 0.05Ap and about 0.70Ap, between about 0.10Ap and about 0.70Ap, between about 0.20Ap and about 0.70Ap, or even between about 0.30Ap and about 0.70Ap.

In embodiments when the at least one cavity is a plurality of cavities, the areal density of the cavities is not particularly limited. In these embodiments, the plurality of cavities may include an areal density of between about 1 cavity/100 $cm^2$ of area Ap to about 5000 cavities/1 $cm^2$ of area Ap, between about 5 cavity/100 $cm^2$ of area Ap to about 2500 cavities/1 $cm^2$ of area Ap, between about 10 cavity/100 $cm^2$ of area Ap to about 1000 cavities/1 $cm^2$ of area Ap, or even between about 20 cavity/100 $cm^2$ of area Ap to about 500 cavities/1 $cm^2$ of area Ap. When a plurality of cavities are used, the plurality of cavities may be arranged randomly across the surface of the abrading layer or may be arranged in a pattern, e.g. a repeating pattern, across the abrading layer. Patterns include, but are not limited to, square arrays, hexagonal arrays and the like. Combination of patterns may be used. In order to provide uniform thermal behavior across the pad, it may be desirable to have the at least one cavity span at least 80 percent, at least 90 percent or even all of the second surface of abrading layer. If a plurality of cavities are used, the plurality of cavities may be uniformly distributed across the second surface of the abrading layer. Uniformly distributed may be defined in terms of the areal density of the plurality of cavities. In some embodiments the plurality of cavities are uniformly distributed across the second surface of the abrading layer such that the areal density of the cavities varies by no greater than 30 percent, no greater than 20 percent, no greater than 15 percent, no greater than 10 percent, no greater than 5 percent or even no greater than 3 percent, when comparing two regions of the abrading layer second surface, where each region has an area of at least about 50 $cm^2$, at least about 100 $cm^2$, or even at least about 200 $cm^2$. In calculating the percentage, the denominator is taken as the average areal density of cavities of the two regions. In some embodiments the areal density of the cavities varies by no greater than 30 percent when comparing two regions of the abrading layer second surface, where each region has an area of at least about 100 $cm^2$. In some embodiments the areal density of the cavities varies by no greater than 15 percent when comparing two regions of the abrading layer second surface, where each region has an area of at least about 100 $cm^2$. In some embodiments the areal density of the cavities varies by no greater than 5 percent when comparing two regions of the abrading layer second surface, where each region has an area of at least about 100 $cm^2$.

The type of material that comprises the phase transition material is not particularly limited, as long as it has a thermally reversible phase transition. In some embodiments, the thermally reversible phase transition of the phase transition material is at least one of a melting point transition, a crystal to crystal transition, a liquid crystal to liquid crystal transition, a liquid crystal to liquid transition and a boiling point transition. In some embodiments, the thermally reversible phase transition of the phase transition material is a melting point transition. In some embodiments, the phase transition material has a melting point between about 5° C. and about 80° C., between about 5° C. and about 60° C., between about 20° C. and about 60° C., or even between about 30° C. and about 50° C. Generally, it is desired to use a phase transition material that has a phase transition temperature less than 100° C. and greater than 0° C., as many lapping operations employ water based coolants or slurries, and it is prudent to remain below the boiling point and above the melting point of water during use. Additionally, it is generally desirable to minimize heating of the abrading layer and/or lapping pad during use, for example maintain the abrading layer temperature or lapping pad temperature below 80° C., below 70° C., below 60° C. or even below 50° C. Thus, phase transition materials having thermally reversible phase transitions from between about 20° C. and about 60° C., between about 30° C. and about 60° C., between about 20° C. and about 50° C., or even between about 30° C. and about 50° C., may be preferred. In some embodiments, the enthalpy of the phase transition of the phase transition material is between about 100 J/g and about 400 J/g, between about 100 J/g and about 250 J/g or even between about 200 J/g to about 400 J/g. In some embodiments, the heat of fusion of the phase transition material is between about 100 J/g and about 400 J/g, between about 100 J/g and about 250 J/g or even between about 200 J/g to about 400 J/g. Generally, higher enthalpies of the phase transition, e.g. higher enthalpies of fusion, may be particularly useful. The molecular weight of the phase transition material is not particularly limited. However, in some embodiments, a lower molecular weight may be desirable, as the phase transition material may then readily flow, when it is above its melting temperature, and be more easily disposed in the at least one cavity of the abrading layer. In some embodiments, the phase transition material has a molecular weight of between about 100 g/mol and about 5000 g/mol, 100 g/mol and about 3000 g/mol, between about 100 g/mol and about 2000 g/mol, or even between about 100 g/mol and about 1000 g/mol.

The phase transition material may be an organic material. The phase transition material may be an organic material that has at least one of a melting point transition, a liquid crystal to liquid crystal transition and a liquid crystal to liquid transition between about 5° C. and about 80° C., between about 5° C. and about 60° C., between about 20° C. and about 60° C., or even between about 30° C. and about 50° C. The phase transition material may be at least one of a paraffin (having the general formula $C_nH_{2n+2}$), paraffin wax, alcohol (e.g. linear hydrocarbon based alcohol), ketone (e.g. linear hydrocarbon based ketones), ester (e.g. linear hydrocarbon based esters), ether (e.g. linear hydrocarbon based ethers), fatty acid (e.g. having the general formula $CH_3(CH_2)_{2n}COOH$), vegetable oil, polyalkyl oxide (e.g. polyethylene oxide and polypropylene oxide) and polyalkyl glycols (polyethylene glycol and polypropylene glycol). Combinations of materials may be used. Paraffin may include, but is not limited to paraffin having the general formula $C_nH_{2n+2}$ wherein n may range from 12 to 40, for example, n-tetradecane, n-pentadecane, n-hexadecane, n-heptadecane, n-octadecane, n-nonadecane, n-eicosane, n-heneicosane, n-docosane, n-tricosane, n-tetracosane, n-pentacosane, n-hexacosane, n-heptacosane, n-octacosane. Paraffin wax typically contain mixtures of hydrocarbon molecules, e.g. mixtures of paraffins which may include other compounds. Alcohols may include, but are not limited to, alcohols having the general formula $C_nH_{2n+2}O$, where n may range between 10 and 26. Ketones may include, but are not limited to, ketones having the general formula $C_nH_{2n}O$, where n may range between 10 and 30. Esters may include, but are not limited to, esters having the general formula $C_nH_{2n}O_2$, where n may range between 10 and 35. In some embodiments, the phase transition material is at least one of a polyethylene glycol and a polypropylene glycol, optionally, wherein the molecular weight of the at least one of a polyethylene glycol and a polypropylene glycol is between about 200 g/mol and 5,000 g/mol, or even between about 200 g/mole and 2,500 g/mol. The phase transition material may include a branched structure. However, due to a more regular structure which may lead to higher enthalpies, e.g. higher enthalpy of fusion, linear compounds may be preferred. In some embodiments, the phase transition material has a linear structure and/or is free of branched structure.

Thermal phase transitions may be measured by thermal analysis techniques known in the art. In some embodiments, the temperature of a phase transition, e.g. a melting point transition, may be taken as the peak temperature recorded in a differential scanning calorimeter heating scan, heating a sample at a rate of 10° C./minute, using a sample having a weight from about 5 to about 10 mg, while running under a nitrogen atmosphere.

Figure 3A:
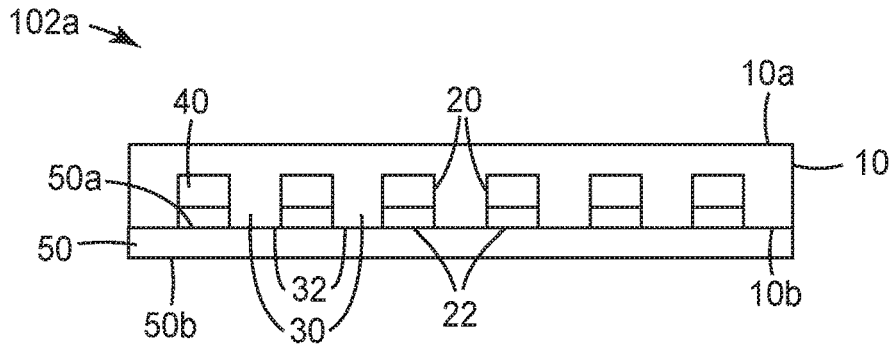
FIG. 3A is a schematic cross-sectional diagram of a lapping pad according to one exemplary embodiment of the present disclosure.

FIG. 3A is a schematic cross-sectional diagram of a lapping pad according to one exemplary embodiment of the present disclosure. FIG. 3A shows lapping pad 102*a*. Lapping pad 102*a* includes an abrading layer 10 having a working surface 10*a* and a second surface 10*b* opposite the working surface, as previously described in, for example, FIGS. 1A and 1B. Abrading layer 10 includes at least one cavity 20, in this exemplary embodiment, a plurality of cavities. The at least one cavity 20 has an opening 22 located at the second surface. The at least one cavity is defined by at least one rib 30, each rib 30 has a distal end 32 at the second surface 10*b*. The exterior surface of the distal end 32 of the at least one rib defines the second surface 10*b*. In this exemplary embodiment, rib 30 is a single rib, i.e. a single continuous rib (as opposed to a plurality of discrete ribs), that define the plurality of cavities. Lapping pad 102*a* includes a phase transition material 40 having a thermally reversible phase transition disposed in the at least one cavity 20. Lapping pad 102*a* further includes a sealing layer 50. Sealing layer 50 has a first surface 50*a* and a second surface 50*b*. In some embodiments, sealing layer 50 is in contact with at least a portion of the second surface 10*b* of the abrading layer 10. In some embodiments, sealing layer 50 is in contact with substantially the entire second surface of the abrading layer. In some embodiments, sealing layer 50 is in contact with and adhered to at least a portion of the second surface 10*b* of the abrading layer 10, i.e. the first surface 50*a* of sealing layer 50 is in contact with and adhered to second surface 10*b* of sealing layer 10. In some embodiments, sealing layer 50 is in contact with and adhered to substantially the entire second surface 10*b* of the abrading layer 10, i.e. the first surface 50*a* of sealing layer 50 is in contact with and adhered to substantially the entire second surface 10*b* of abrading layer 10. One purpose of sealing layer 50 is to seal the at least one cavity 20 and thereby enclose phase transition material 40 in the at least one cavity 20. Sealing layer 50, generally, contacts the exterior surface of distal end 32 of the at least one rib 30, as the exterior surface of the distal end 32 of the at least one rib defines second surface 10*b*. If the lapping pad includes a containment rib, e.g. containment rib 36 having distal end 38 of FIGS. 2A and 2B, sealing layer 50 may be in contact with at least a portion of the distal end of the containment rib. In some embodiments, sealing layer 50 may be in contact with substantially the entire distal end of the containment rib. In some embodiments, sealing layer 50 may be in contact with and adhered to at least a portion of the distal end of the containment rib. In some embodiments, sealing layer 50 may be in contact with and adhered to substantially the entire distal end of the containment rib.

The size of the sealing layer is not particularly limited. However, it will generally be of similar size as that of the lapping pad, e.g. the sealing layer may have an area similar in size to surface area Ap of the lapping pad. In some embodiment, the area of first surface 50*a* of sealing layer 50 is as follows: $0.7 \leq Ap \leq 1.3$. Generally, the sealing layer will seal the at least one cavity of the lapping pad and, if a plurality of cavities are present in the lapping pad, the sealing layer will seal at least 30 percent, at least 50 percent, at least 70 percent, at least 90 percent at least 95 percent, at least 99 percent or even 100 percent of the plurality of cavities. The sealing layer may seal the at least one cavity, thereby preventing fluid from escaping the at least one cavity of the abrasive layer. However, due to imperfections in the seal, the abrading layer may exhibit minor leakage of the phase transition material during use and still function in an acceptable manner. The thickness of the sealing layer is not particularly limited. In some embodiments the sealing layer is a film, wherein the film has a thickness of less than about 2 mm, less than about 1 mm, less than about 0.5 mm, less than about 0.25, less than about 0.10 mm or even less than about 0.05 mm. In some embodiments, the sealing layer includes a film capable of exhibiting a radius of curvature of less than 10 cm, less than 5 cm, less than 3 cm or even less than 1 cm.

The material comprising the sealing layer is not particularly limited. In some embodiments, the sealing layer may be at least one of a polymer, a metal, semi-metal or an inorganic oxide. The sealing layer may be a polymer sealing layer, which includes at least one polymer. The sealing layer may include a polymer film, e.g. a thermoplastic polymer film. Due to handling characteristic, the ability to use multiple layers which may have different properties, e.g. adhesive properties, and cost considerations, sealing layers that comprise a polymer film may have particular utility. The sealing layer may include at least one of a thermoplastic and a thermoset. The sealing layer may include an adhesive, e.g. the sealing layer may be an adhesive layer. The adhesive may be one of a pressure sensitive adhesive, heat activated adhesive and thermosetting adhesive. Pressure sensitive adhesives and heat activated adhesives may have particular utility. If the sealing layer comprises an adhesive, the adhesive may be used to not only seal the at least one cavity of the abrading layer, it may also be capable of adhering the abrading layer to another substrate, e.g. the platen of a lapping tool.

In some embodiments, the sealing layer includes a first adhesive layer, having a first surface and a second surface, wherein the first surface of the first adhesive layer is adhered to the second surface of the abrading layer. In some embodiments, the first adhesive layer is a continuous, solid adhesive layer, which seals at least a portion of the at least one cavity. In some embodiments, the first adhesive layer is a continuous, solid adhesive layer, which seals the at least one cavity. In some embodiments, when the at least one cavity is a plurality of cavities, the first adhesive layer is a continuous, solid adhesive layer, which seals at least a portion of the cavities. In some embodiments, when the at least one cavity is a plurality of cavities, the first adhesive layer is a continuous, solid adhesive layer that seals at least 30 percent, at least 50 percent, at least 70 percent, at least 90 percent at least 95 percent, at least 99 percent or even 100 percent of the plurality of cavities.

In some embodiments, the sealing layer further comprises a polymer film having a first surface and a second surface, wherein the first surface of the polymer film is in contact with the second surface of the first adhesive layer, e.g. the sealing layer is a single sided tape or transfer tape. In some embodiments, the polymer film is a release liner. In some embodiments, the release liner includes a releasable surface in contact with the second surface of the first adhesive layer. In some embodiments, the releasable surface includes a releasable coating, optionally, wherein the releasable coating is at least one of silicone and fluorochemical, e.g. fluoropolymer. In some embodiments, the sealing layer further comprises a second adhesive layer in contact with the second surface of the polymer film, e.g. the sealing layer is a double sided tape, e.g. a double side tape wherein the first and second adhesive layers are pressure sensitive adhesives.

The second adhesive layer may be at least one of a pressure sensitive adhesive, a heat activated adhesive and a thermosetting adhesive. In some embodiments, the sealing layer may be at least one of a single sided tape, a double sided tape and a transfer tape, e.g. an adhesive transfer tape. If the sealing layer is a transfer tape, the release liner may be included with the lapping pad until time of use, in order to protect the adhesive of the transfer tape from dust, dirt and marring. In some embodiments, the transfer tape includes a pressure sensitive adhesive.

In some embodiments, the sealing layer comprises a polymer film, having a first surface and a second surface, wherein the first surface of the polymer film is adhered to and in contact with the second surface of the abrading layer. The polymer film may be a thermoplastic. The sealing layer may further include an adhesive layer in contact with the second surface of the polymer film. The adhesive layer may be at least one of a pressure sensitive adhesive, a heat activated adhesive and a thermosetting adhesive.

The sealing layer may be a multi-layer sealing layer, i.e. have two or more layers, typically each layer having different properties. The multiple layers of a multi-layer sealing layer may each include a polymer, optionally each layer may include at least about 70 percent, at least about 80 percent, at least about 90 percent, at least about 95 percent, at about 99 percent or even at least about 100 percent by weight polymer.

Figure 3B:
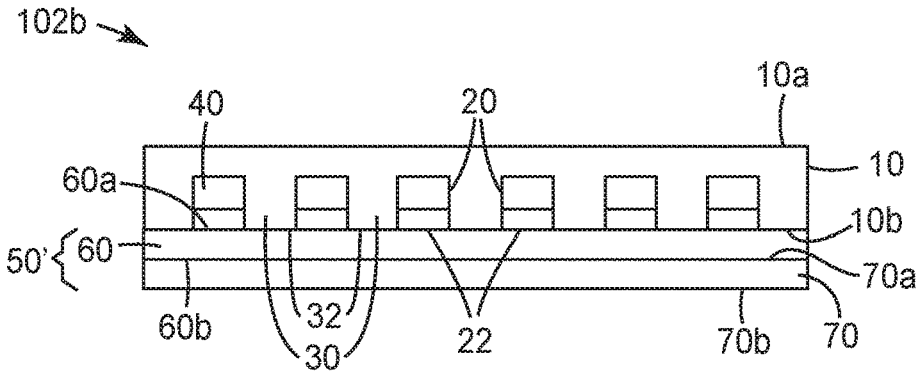
FIG. 3B is a schematic cross-sectional diagram of a lapping pad according to one exemplary embodiment of the present disclosure.

FIG. 3*b* is a schematic cross-sectional diagram of a lapping pad according to one exemplary embodiment of the present disclosure. FIG. 3B includes lapping pad 102*b*, which is similar to lapping pad 102*a* of FIG. 3A, as previously described, except lapping pad 102*b* includes a multi-layer sealing layer 50'. Multi-layer sealing layer 50' includes a first substrate 60 having a first surface 60*a* and a second surface 60*b*, with first surface 60*a* in contact with second surface 10*b* of abrasive layer 10, and a second substrate 70 having a first surface 70*a* and a second surface 70*b*, with first surface 70*a* in contact with second surface 60*b* of first substrate 60. First substrate 60 and second substrate 70 may be any of the previously described materials of sealing layer 50. In some embodiments, multi-layer sealing layer 50' is a single sided tape or transfer tape, e.g. an adhesive transfer tape, with first substrate 60 being an adhesive layer and second substrate 70 being a backing or liner, e.g. a release liner.

In some embodiments, first substrate 60 may be a discontinuous layer, e.g. a discontinuous adhesive layer, disposed only on the surface 10*b* of abrasive layer 10 (disposed on distal end 32 of the at least one rib 30) that does not seal the at least one cavity 20 (discontinuous adhesive layer not shown in FIG. 3B). Second substrate 70 may then be a continuous film e.g. polymer film or substrate, e.g. the platen of a lapping tool, that may seal the at least one cavity 20.

Figure 3C:
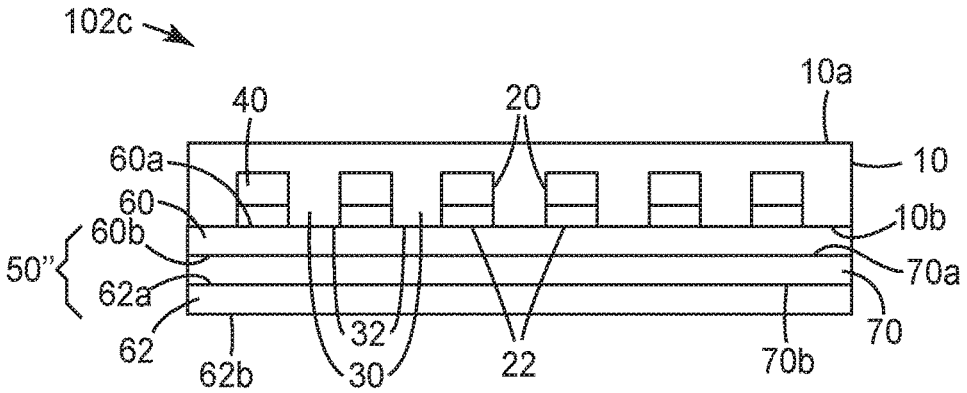
FIG. 3C is a schematic cross-sectional diagram of a lapping pad according to one exemplary embodiment of the present disclosure.

FIG. 3C is a schematic cross-sectional diagram of a lapping pad according to one exemplary embodiment of the present disclosure. FIG. 3C includes lapping pad 102*c*, which is similar to lapping pad 102*b* of FIG. 3B, as previously described, except lapping pad 102*c* includes a multi-layer sealing layer 50" which further includes a third substrate 62 having a first surface 62*a* and a second surface 62*b*, wherein first surface 62*a* of third substrate 62 is in contact with the second surface 70*b* of second substrate 70. Third substrate 62 may be any of the previously described materials of sealing layer 50. In some embodiments, multi-layer sealing layer 50" is a double sided tape, with first substrate 60 being an adhesive layer and second substrate 70 being a backing and third substrate 62 being an adhesive layer. The adhesive layer 60 and 62 may be may be at least one of a pressure sensitive adhesive, a heat activated adhesive and a thermosetting adhesive.

The backings, liners and release liners of the present disclosure may be those known in the art. The backings, liners and release liners of the present disclosure may include a polymer film, optionally wherein the polymer film has a thickness of less than about 1 mm, less than about 0.5 mm, less than about 0.25, less than about 0.10 mm, less than about 0.05 mm, or even less than about 0.02 mm. The thickness of the polymer film may be greater than about 0.003 mm, greater than about 0.005 mm or even greater than about 0.010 mm. The backings, liners and release liners of the present disclosure may include a polymer, including but not limited to, thermoplastics, thermoplastic elastomers (TPEs), e.g. TPEs based on block copolymers, thermosets, e.g. elastomers and combinations thereof. Thermoplastics and TPEs include, but are not limited to polyurethanes; polyalkylenes, e.g. polyethylene and polypropylene; polybutadiene, polyisoprene; polyalkylene oxides, e.g. polyethylene oxide; polyesters, e.g. polyethyleneterephthalate; polyamides; polycarbonates, polystyrenes, block copolymers of any of the proceeding polymers, and the like, including combinations thereof. Polymer blends may also be employed.

The adhesive layers of the present disclosure may include at least one of a pressure sensitive adhesive, a hot melt adhesive and a thermosetting adhesive. Pressure sensitive adhesives that may be used in the adhesive layers of the present disclosure include, but are not limited to, those based on acrylates, silicones, nitrile rubber, butyl rubber, natural rubber, styrene block copolymers, urethane and the like. Pressure sensitive adhesives based on poly(meth)acrylates are particularly suitable. In one embodiment, the pressure sensitive adhesives are optically clear. Use of optically clear adhesives may facilitate optical endpoint detection systems used to determine the extent of lapping/polishing of a substrate. Suitable examples of such optically clear pressure sensitive adhesives are described, for example, in U.S. Pat. No. 8,361,632 (Everaerts, et. al.) and U.S. Pat. No. 8,361,633 (Everaerts, et. al.), U.S. Pat. Publ. Nos. 2009/087629 (Everaerts, et. al.), 2010/0040842 (Everaerts, et. al.), 2010/0136265 (Everaerts, et. al.), and PCT publication WO 2012/112856 (Xia, et. al.), all incorporated herein by reference.

Heat activated adhesives are adhesives that may act as an adhesive, e.g. a pressure sensitive adhesive or structural adhesive, at ambient or use temperature, while having the ability to flow, similar to a liquid, at an elevated temperature. Heat activated adhesives include hot melt adhesives, are adhesives that are semi-crystalline or amorphous and have the ability to flow when they are heated to a temperature above their crystalline melting temperature, Tm, and/or above their glass transition temperature, Tg. Once cooled back to a temperature below their Tm and/or Tg, the hot melt adhesive solidifies and provides adhesive properties. The hot melt adhesive may include at least one of a polyurethane, polyamide, polyester, polyacrylate, polyolefin, polycarbonate and epoxy resin. The hot melt adhesive may be capable of being cured. Curing the hot melt adhesive may comprise at least one of moisture curing, thermal curing and actinic radiation curing. Heat activated adhesives may include the adhesives disclosed in U.S. Pat. Publ. No. 2012/0325402 (Suwa, et. al.) and U.S. Pat. No. 7,008,680 (Everaerts, et. al.) and U.S. Pat. No. 5,905,099 (Everaerts, et. al.), all incorporated herein by reference.

The present disclosure also provides a method of making a lapping pad including: providing an abrading layer, wherein the abrading layer has a working surface, a second surface opposite the working surface having a projected area Ap, and at least one cavity having a cavity opening located at the second surface, the at least one cavity being defined by at least one rib, each rib having a distal end at the second surface, wherein the total area of the cavity opening of the at least one cavity is between about 0.05Ap and about 0.995AP; providing a phase transition material having a thermally revisable phase transition; and disposing the phase transition material in the at least one cavity. The method may further include the step of removing excess phase transition material from at least a portion of the distal end of the at least one rib and/or providing a sealing layer and laminating the sealing layer to at least a portion of the second surface of the abrading layer.

Figure 4A:
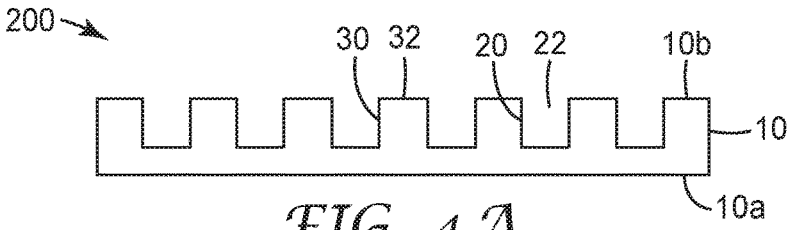
FIGS. 4A-4E are a series of schematic diagrams depicting a method of making a lapping pad according to one exemplary method of the present disclosure.
Figure 4B:
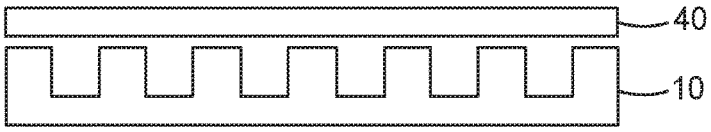
Figure 4C:
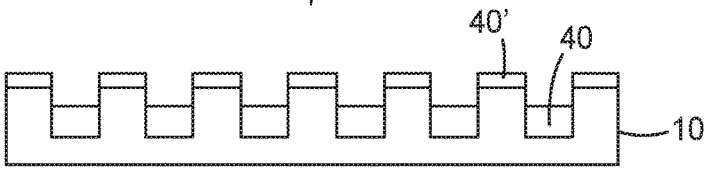
Figure 4D:
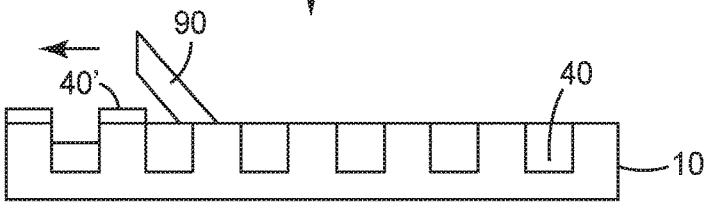
Figure 4E:
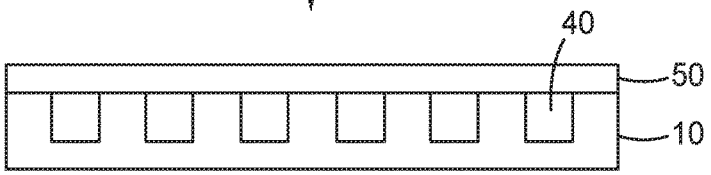

FIGS. 4A-4E are a series of schematic diagrams depicting a method of making a lapping pad according to one exemplary method of the present disclosure. FIGS. 4A-4E shows method 200 which includes providing an abrading layer 10, wherein the abrading layer has a working surface 10*a*, a second surface 10*b* opposite the working surface having a projected area Ap, and at least one cavity 20 having a cavity opening 22 located at the second surface, the at least one cavity being defined by at least one rib 30, each rib having a distal end 32 at the second surface, wherein the total area of the cavity opening of the at least one cavity is between about 0.05Ap and about 0.995Ap (FIG. 4A), providing a phase transition material 40 having a thermally revisable phase transition (FIG. 4B); and disposing the phase transition material in the at least one cavity (FIG. 4C). In one embodiment, the disposing step includes melting a phase transition material having a melting point transition and allowing the phase transition material to flow into the at least one cavity. In some embodiments, a force may be applied to the phase transition material to facilitate the disposing step, e.g. facilitate the flow of the phase transition material into the at least one cavity. A blade, e.g. doctor blade or wiper blade, may be used to provide the force. The disposing step may include at least one of coating (when the phase transition material is a liquid), laminating techniques (when the phase transition material is a solid film) and printing, e.g. 3-dimensional printing. Additionally, the method may further include the step of removing excess phase transition material from at least a portion of the distal end of the at least one rib (FIG. 4D). A blade 90, e.g. doctor blade or wiper blade may be used to remove excess phase transition material 40' from at least a portion of the distal end 32 of the at least one rib 30, i.e. from second surface 10*b*. For example, in FIG. 4D, blade 90 wipes excess phase transition material 40' from second surface 10*b* (from at least one rib 30 having one distal end 32). The method may further include the step of providing a sealing layer 50 and laminating the sealing layer to at least a portion of second surface 10*b* of the abrading layer 10 (FIG. 4E). Sealing layer 50 may be any of the sealing layers, for example sealing layer 50, 50' and 50", of the present disclosure. Conventional lamination processes and procedures may be used to laminate the sealing layer to at least a portion of the second surface of the abrading layer. In some embodiments, sealing layer 50 may be laminated to at least about 50 percent, at least about 60 percent, at least about 70 percent, at least about 80 percent, at least about 90 percent, at least about 95 percent at least about 99 percent or even at least about 100 percent of the surface of second surface 10*b* of the abrading layer 10.

In another embodiment the present disclosure relates to a lapping system, the lapping system includes any one of the lapping pads of the present disclosure and a working fluid. The lapping pad may include any of the previous disclosed abrading layers of the present disclosure. The working fluid used is not particularly limited and may be any of those known in the art. The working fluid may be aqueous or non-aqueous. An aqueous working fluid is defined as a solution having a liquid phase (does not include particles, if the lapping solution is a slurry) that is at least 50% by weight water. A non-aqueous working fluid is defined as a working fluid having a liquid phase that is less than 50% by weight water. In some embodiments, the working fluid is a slurry, i.e. a liquid that contains organic or inorganic abrasive particles or combinations thereof. The working fluid may be an aqueous slurry. The concentration of organic or inorganic abrasive particles or combination thereof in the working fluid is not particularly limited. The concentration of organic or inorganic abrasive particles or combinations thereof in the working fluid may be, greater than about 0.5%, greater than about 1%, greater than about 2%, greater than about 3%, greater than about 4% or even greater than about 5% by weight; may be less than about 30%, less than about 20% less than about 15% or even less than about 10% by weight. In some embodiments, the working fluid is substantially free of organic or inorganic abrasive particles. By "substantially free of organic or inorganic abrasive particles" it is meant that the working fluid contains less than about 0.5%, less than about 0.25%, less than about 0.1% or even less than about 0.05% by weight of organic or inorganic abrasive particles. In one embodiment, the working fluid may contain no organic or inorganic abrasive particles. The lapping system may include working fluids, e.g. slurries, used for the lapping and/or polishing of hard substrates including metal oxides, e.g. sapphire lapping. Additionally the lapping system may be used for the lapping/polishing of substrates used in the fabrication of electronic devices, e.g. wafer lapping/polishing, including silicon lapping/polishing, silicon oxide lapping/polishing, tungsten chemical mechanical planarization (CMP), copper CMP and aluminum CMP; barrier CMP, including but not limited to tantalum and tantalum nitride CMP, oxide CMP, and the like. The polishing system may further include a substrate to be lapped or polished, e.g. sapphire.

General procedures for the lapping and polishing of substrates are known in the art and may include a lapping/polishing tool which includes a platen which may rotate and upon which the lapping pad is mounted, a carrier which may rotate and which holds the substrate to be lapped. The surface of the substrate to be lapped is brought into contact with the lapping pad mounted on the platen and the substrate and pad are moved relative to one another. As well as rotating, the lapping pad or substrate may also be traversed in a linear direction, if the tool design allows for such movement. The polishing tool may also include a conditioning arm and conditioner carrier, upon which a pad conditioner may be mounted and rotated. The pad conditioner may contact the lapping pad surface, regenerating the surface for further lapping/polishing, as is known in the art. During lapping/polishing, a working fluid, e.g. a slurry, and/or a coolant, may be applied to the interface between the lapping pad working surface and substrate surface to facilitate the lapping/polishing process. In one embodiment, the present disclosure provides a method for lapping a substrate including providing a lapping pad according to claim 1; providing a substrate; contacting the working surface of the lapping pad with the substrate surface; moving the lapping pad and the substrate relative to one another while maintaining contact between the working surface of the lapping pad and the substrate surface; and, optionally, wherein lapping is conducted in the presence of a working fluid. In some embodiments, the working fluid is a slurry and the lapping pad is substantially free of inorganic abrasive material having a mohs hardness greater than about 5, greater than about 7 or even greater than about 8. In some embodiments the substrate includes at least one of a sapphire substrate and a semiconductor wafer substrate.

In another embodiment, the present disclosure provides method of lapping a substrate comprising:

providing a lapping pad according to any one of the lapping pads of the present disclosure;

providing a substrate;

contacting the working surface of the lapping pad with the substrate surface;

moving the lapping pad and the substrate relative to one another while maintaining contact between the working surface of the lapping pad and the substrate surface; and wherein lapping is conducted in the presence of a working fluid. The working fluid may be a slurry, e.g. an aqueous slurry. The substrate may include at least one of a sapphire substrate and a semiconductor wafer substrate.

Select embodiments of the present disclosure include, but are not limited to, the following:

In a first embodiment, the present disclosure provides a lapping pad comprising:

an abrading layer, wherein the abrading layer has a working surface, a second surface opposite the working surface having a projected area Ap, and at least one cavity having a cavity opening located at the second surface, the at least one cavity being defined by at least one rib, each rib having a distal end at the second surface; and a phase transition material having a thermally reversible phase transition, wherein the phase transition material is disposed in the at least one cavity; and wherein the total area of the cavity opening of the at least one cavity is between about 0.05Ap and about 0.995Ap.

In a second embodiment, the present disclosure provides a lapping pad according to the first embodiment, wherein the abrading layer comprises polymer.

In a third embodiment, the present disclosure provides a lapping pad according to the first or second embodiments, wherein the abrading layer comprises from about 80 percent to about 100 percent by weight polymer.

In a fourth embodiment, the present disclosure provides a lapping pad according to any one of the first through third embodiments, wherein the total area of the cavity opening of the at least one cavity is between about 0.10Ap and about 0.95Ap.

In a fifth embodiment, the present disclosure provides a lapping pad according to any one of the first through fourth embodiments, wherein the total area of the cavity opening of the at least one cavity is between about 0.20Ap and about 0.90Ap.

In a sixth embodiment, the present disclosure provides a lapping pad according to any one of the first through fifth embodiments, wherein the at least one cavity is a plurality of cavities, the plurality of cavities having an areal density of between about 1 cavity/100 $cm^2$ of area Ap to about 5000 cavities/1 $cm^2$ of area Ap.

In a seventh embodiment, the present disclosure provides a lapping pad according to any one of the first through sixth embodiments, wherein the plurality of cavities are precisely shaped.

In an eighth embodiment, the present disclosure provides a lapping pad according to any one of the first through seventh embodiments, wherein the thermally reversible phase transition is at least one of a melting point transition, a crystal to crystal transition, a liquid crystal to liquid crystal transition, a liquid crystal to liquid transition and a boiling point transition.

In a ninth embodiment, the present disclosure provides a lapping pad according to any one of the first through eighth embodiments, wherein the phase transition material has a melting point between about 5° C. and about 80° C.

In a tenth embodiment, the present disclosure provides a lapping pad according to any one of the first through ninth embodiments, wherein the phase transition material has a melting point between about 20° C. and about 60° C.

In an eleventh embodiment, the present disclosure provides a lapping pad according to any one of the first through tenth embodiments, wherein the phase transition material has a melting point between about 30° C. and about 50° C.

In a twelfth embodiment, the present disclosure provides a lapping pad according to any one of the first through eleventh embodiments, wherein the enthalpy of the phase transition of the phase transition material is between about 100 J/g and about 400 J/g.

In a thirteenth embodiment, the present disclosure provides a lapping pad according to any one of the first through twelfth embodiments, wherein the heat of fusion of the phase transition material is between about 100 J/g and about 400 J/g.

In a fourteenth embodiment, the present disclosure provides a lapping pad according to any one of the first through thirteenth embodiments, wherein the phase transition material has a molecular weight of between about 100 g/mol and about 3000 g/mol.

In a fifteenth embodiment, the present disclosure provides a lapping pad according to any one of the first through fourteenth embodiments, wherein the phase transition materials is at least one of a paraffin, paraffin wax, alcohol, ketone, ester, ether, fatty acid, vegetable oil, polyalkyl oxide and polyalkyl glycol.

In a sixteenth embodiment, the present disclosure provides a lapping pad according to any one of the first through fifteenth embodiments, wherein the phase transition material is at least one of polyethylene glycol and polypropylene glycol.

In a seventeenth embodiment, the present disclosure provides a lapping pad according to any one of the first through sixteenth embodiments further comprising a sealing layer in contact with at least a portion of the second surface of the abrading layer.

In an eighteenth embodiment, the present disclosure provides a lapping pad according to the seventeenth embodiment, wherein the sealing layer comprises a first adhesive layer, having a first surface and a second surface, wherein the first surface of the first adhesive layer is adhered to the second surface of the abrading layer.

In a nineteenth embodiment, the present disclosure provides a lapping pad according to the eighteenth embodiment, wherein the first adhesive layer is a continuous, solid adhesive layer, which seals at least a portion of the at least one cavity.

In a twentieth embodiment, the present disclosure provides a lapping pad according to the eighteenth or nineteenth embodiments, wherein the sealing layer further comprises a polymer film having a first surface and a second surface, wherein the first surface of the polymer film is in contact with the second surface of the first adhesive layer.

In a twenty-first embodiment, the present disclosure provides a lapping pad according to the twentieth embodiment, wherein the polymer film is a release liner.

In a twenty-second embodiment, the present disclosure provides a lapping pad according to the twentieth or twenty-first embodiments, wherein the sealing layer further comprises a second adhesive layer in contact with the second surface of the polymer film.

In a twenty-third embodiment, the present disclosure provides a lapping pad according to any one of the eighteenth through twenty-second embodiments, wherein the first adhesive layer is at least one of a pressure sensitive adhesive, a heat activated adhesive and a thermosetting adhesive and, if present, the second adhesive layer is at least one of a pressure sensitive adhesive, a heat activated adhesive and a thermosetting adhesive.

In a twenty-fourth embodiment, the present disclosure provides a lapping pad according to any one of the eighteenth through twenty-second embodiments, wherein the first adhesive layer is at least one of a pressure sensitive adhesive, a heat activated adhesive and a thermosetting adhesive and, if present, the second adhesive layer is at least one of a pressure sensitive adhesive, a heat activated adhesive and a thermosetting adhesive.

In a twenty-fifth embodiment, the present disclosure provides a lapping pad according to the seventeenth embodiment, wherein the sealing layer comprises a polymer film, having a first surface and a second surface, wherein the first surface of the polymer film is adhered to and in contact with the second surface of the abrading layer.

In a twenty-sixth embodiment, the present disclosure provides a lapping pad according to the twenty-fifth embodiment, wherein the sealing layer further comprises an adhesive layer in contact with the second surface of the polymer film.

In a twenty-seventh embodiment, the present disclosure provides a lapping pad according to the eighteenth embodiment, wherein the first adhesive layer is at least one of a pressure sensitive adhesive, a heat activated adhesive and a thermosetting adhesive.

In a twenty-eighth embodiment, the present disclosure provides a lapping pad according to any one of the seventeenth through twenty-seventh embodiments, wherein the sealing layer is at least one of a single sided tape, a double sided tape and an adhesive transfer tape.

In a twenty-ninth embodiment, the present disclosure provides a lapping pad according to any one of the first through twenty-eighth embodiments, wherein the lapping pad contains less than 5 percent by weight inorganic material.

In a thirtieth embodiment, the present disclosure provides a lapping pad according to any one of the first through twenty-ninth embodiments, wherein the lapping pad contains less than 5 percent by weight inorganic abrasive particles having a mohs hardness of 5.0 or greater.

In a thirty-first embodiment, the present disclosure provides a lapping system comprising a lapping pad according to any one of the first through thirtieth embodiments and a working fluid.

In a thirty-second embodiment the present disclosure provides a lapping system according to the thirty-first embodiment, wherein the working fluid is a slurry.

In a thirty-third embodiment, the present disclosure provides a method of making a lapping pad comprising:

providing an abrading layer, wherein the abrading layer has a working surface, a second surface opposite the working surface having a projected area Ap, and at least one cavity having a cavity opening located at the second surface, the at least one cavity being defined by at least one rib, each rib having a distal end at the second surface, wherein the total area of the cavity opening of the at least one cavity is between about 0.05Ap and about 0.995Ap;

providing a phase transition material having a thermally revisable phase transition;

and disposing the phase transition material in the at least one cavity.

In a thirty-fourth embodiment the present disclosure provides a method of making a lapping pad according to the thirty-third embodiment further comprising the step of removing excess phase transition material from at least a portion of the distal end of the at least one rib.

In a thirty-fifth embodiment the present disclosure provides a method of making a lapping pad according to the thirty-third or thirty-fourth embodiments, further comprising the step of providing a sealing layer and laminating the sealing layer to at least a portion of the second surface of the abrading layer.

In a thirty-sixth embodiment, the present disclosure provides a method of lapping a substrate comprising:

providing a lapping pad according to any one of the first through thirtieth embodiments;

providing a substrate;

contacting the working surface of the lapping pad with the substrate surface; and moving the lapping pad and the substrate relative to one another while maintaining contact between the working surface of the lapping pad and the substrate surface; and wherein lapping is conducted in the presence of a working fluid.

In a thirty-seventh embodiment the present disclosure provides method of lapping a substrate according to the thirty-sixth embodiment, wherein the working fluid is a slurry.

In a thirty-eighth embodiment the present disclosure provides method of lapping a substrate according to the thirty-sixth or thirty-seventh embodiments, wherein the substrate is at least one of a sapphire substrate and a semiconductor wafer substrate.

Examples

MATERIALS

| ABBREVIATION | DESCRIPTION |
|---|---|
| PEG1000 | A polyethylene glycol with a molecular weight of about 1,000 g/mol available under the trade designation "polyethylene glycol 1000" from Wako Pure Chemical Industries, Ltd., 1-2 Doshomachi 3-Chome, Chuo-ku, Osaka 540-8605, Japan. |

-continued

| MATERIALS | |
|---|---|
| ABBREVIATION | DESCRIPTION |
| PEG1540 | A polyethylene glycol with a molecular weight of about 1,540 g/mol available under the trade designation "polyethylene glycol 1540" from Wako Pure Chemical Industries, Ltd., 1-2 Doshomachi 3-Chome, Chuo-ku, Osaka 540-8605, Japan. |
| 1-Hexadecanol | 1-hexadecanol, available under the trade designation "1-Hexadecanol" from Wako Pure Chemical Industries, Ltd., 1-2 Doshomachi 3-Chome, Chuo-ku, Osaka 540-8605, Japan. |
| 1-Tetradecanol | 1-tetradecanol, available under the trade designation "1-Tetradecanol" from Wako Pure Chemical Industries, Ltd., 1-2 Doshomachi 3-Chome, Chuo-ku, Osaka 540-8605, Japan. |
| Eicosane | Eicosane, available under the trade designation "Eicosane" from Wako Pure Chemical Industries, Ltd., 1-2 Doshomachi 3-Chome, Chuo-ku, Osaka 540-8605, Japan. |

| Melting Temperature and Heat of Fusion of Phase Transition Materials (literature values) | | |
|---|---|---|
| Material | Melting Temperature (° C.) | Enthalpy of Fusion (J/g) |
| PEG 1000 | 40 | 169 |
| PEG 1540 | 46 | 155 |
| 1-Hexadecanol | 38 | 221 |
| Eicosane | 49 | 137 |
| 1-Tetradecanol | 37 | 241 |

Test Methods and Preparation Procedures

Pad Surface Temperature Measurement

A polishing pad was attached to the surface of a hot plate, held at about 56° C., using a conventional pressure sensitive adhesive. Once attached, the pad surface temperature was monitored as a function of time, using an infrared thermometer available under the trade designation IR-303 from Custom Corporation, Tokyo, Japan.

Preparation of Lapping Pads

A lapping pad was prepared by taking a 15 cm×15 cm piece of an abrading layer having a plurality of cavities on its second surface and placing it on a hot plate having a set temperature of about 195° C. A phase transition material was applied to the surface of the abrading layer and allowed to melt. Using a squeegee blade, the phase transition material was forced into the cavities of the second surface and excess phase transition material was wiped from the abrading layer surface. The abrading layer was removed from the hot plate and the phase transition material was allowed to cool and solidify. A 15 cm×15 cm piece of 442JA Double Sided Film Tape, available from the 3M Company, St. Paul, Minn., was laminated to the second surface, sealing the cavities which contained the phase transition material, thereby forming a lapping pad.

The abrading layer was fabricated from conventional polypropylene using a standard embossing process to form the cavities in an initially flat surfaced polypropylene sheet. The cavity dimensions for each Example are shown in Table 1, below. The metal tool, used for embossing and which had the inverse pattern as that desired for the cavities, was formed by a conventional diamond turning process of a metal.

TABLE 1

| Pro-pylene Sheet | Cavity Shape | Cavity Depth (micron) | Cavity Length (micron) | Cavity Width (micron) | Areal Density of Cavities (#/cm$^2$) | Total Area of Cavity Opening |
|---|---|---|---|---|---|---|
| PP-1 | Rectangular | 800 | 2600 | 1400 | 6.3 | 0.42 Ap |
| PP-2 | Rectangular | 500 | 750 | 750 | 44 | 0.25 Ap |
| PP-3 | Rectangular | 150 | 200 | 100 | 1111 | 0.44 Ap |
| PP-4 | Hexagonal Cylinder | 800 | 3500* | — | 5.5 | 0.57 Ap |

*Edge to opposite edge distance across the surface of hexagonal cylinder.

TABLE 2

| Example | Polypropylene Sheet | Phase Transition Material |
|---|---|---|
| 1 | PP-1 | PEG1000 |
| 2 | PP-1 | PEG1540 |
| 3 | PP-1 | 1-Hexadecanol |
| 4 | PP-1 | Eicosane |
| 5 | PP-1 | 1-Tetradecanol |
| CE-A | PP-1 | None |
| 6 | PP-2 | PEG1000 |
| 7 | PP-2 | PEG1540 |
| 8 | PP-2 | 1-Hexadecanol |
| 9 | PP-2 | Eicosane |
| 10 | PP-2 | 1-Tetradecanol |
| CE-B | PP-2 | None |
| 11 | PP-3 | PEG1000 |
| 12 | PP-3 | PEG1540 |
| 13 | PP-3 | 1-Hexadecanol |
| 14 | PP-3 | Eicosane |
| 15 | PP-3 | 1-Tetradecanol |
| CE-C | PP-3 | None |
| 16 | PP-4 | PEG1000 |
| 17 | PP-4 | PEG1540 |
| 18 | PP-4 | 1-Hexadecanol |
| 19 | PP-4 | Eicosane |
| 20 | PP-4 | 1-Tetradecanol |
| CE-D | PP-4 | None |

Using the "Pad Surface Temperature Measurement" test method described above, each example and comparative example pad was tested. Results are shown in Tables 3 through 6.

TABLE 3

| Time | Pad Surface Temperature (° C.) | | | | | |
|---|---|---|---|---|---|---|
| (Seconds) | Ex. 1 | Ex. 2 | Ex. 3 | Ex. 4 | Ex. 5 | CE-A |
| 0 | 29.4 | 29.8 | 28.9 | 28.1 | 28.6 | 30.3 |
| 10 | 31.9 | 34.9 | 35 | 35.4 | 34.3 | 33.3 |
| 20 | 34.3 | 36.9 | 40.3 | 38.1 | 37.3 | 34.8 |
| 30 | 36.5 | 41.7 | 44.8 | 39.6 | 37.2 | 38.5 |
| 40 | 40 | 43.1 | 47.1 | 38.9 | 37.7 | 39.6 |
| 50 | 44.6 | 44.1 | 47.6 | 40.4 | 38.5 | 41.7 |
| 60 | 47.4 | 44.8 | 48.6 | 41.4 | 39.3 | 44.5 |
| 70 | 49.1 | 45.5 | 49 | 44 | 39.9 | 45.9 |
| 80 | 50 | 46.1 | 49.4 | 49 | 41.5 | 47.2 |
| 90 | 50.9 | 46.7 | 49.4 | 50.8 | 43.9 | 47.7 |
| 100 | 51.3 | 47.4 | 49.6 | 51.7 | 45 | 49.1 |
| 110 | 51.9 | 48.3 | 49.6 | 52.4 | 47.8 | 49.6 |
| 120 | 52.3 | 49.6 | 50.1 | 52.8 | 48.4 | 50.3 |
| 150 | 52.6 | 52.8 | 50.8 | 54 | 51.4 | 51.4 |
| 180 | 52.9 | 53.9 | 52.8 | 54.1 | 52.7 | 51.9 |
| 210 | 53.3 | 54.1 | 53.7 | 54.2 | 53.1 | 51.9 |
| 240 | 53.3 | 54.3 | 53.9 | 53.8 | 53.4 | 52.3 |
| 300 | 53.3 | 53.9 | 53.6 | 53.8 | 53.4 | 52.4 |

TABLE 4

| Time | Pad Surface Temperature (° C.) | | | | | |
|---|---|---|---|---|---|---|
| (Seconds) | Ex. 6 | Ex. 7 | Ex 8 | Ex. 9 | Ex. 10 | CE-B |
| 0 | 30.4 | 28.7 | 29.2 | 29.2 | 28.3 | 30.6 |
| 10 | 35.8 | 38.3 | 34.1 | 34.1 | 37.2 | 36.8 |
| 20 | 40.1 | 43.6 | 37.2 | 37.2 | 44.9 | 40.6 |
| 30 | 44.4 | 47.9 | 44.6 | 44.6 | 49.5 | 44.4 |
| 40 | 48 | 49.4 | 46.1 | 46.1 | 52.8 | 47.3 |
| 50 | 50.3 | 51.9 | 49.6 | 49.6 | 54.4 | 48.4 |
| 60 | 51.6 | 54.7 | 49.9 | 49.9 | 55.2 | 51.1 |
| 70 | 52.6 | 55.6 | 50.9 | 50.9 | 55.9 | 51.6 |
| 80 | 53.4 | 56 | 52.9 | 52.9 | 56.3 | 53 |
| 90 | 53.8 | 56.3 | 53.6 | 53.6 | 56.3 | 53.6 |
| 100 | 54.1 | 56.3 | 53.9 | 53.9 | 56.3 | 54 |
| 110 | 54.3 | 56.4 | 54.4 | 54.4 | 56.4 | 54.1 |
| 120 | 54.4 | 56.4 | 54.4 | 54.4 | 56.5 | 54.4 |
| 150 | 54.7 | 56.4 | 54.5 | 54.5 | 56.6 | 54.5 |
| 180 | 54.5 | 56.5 | 54.4 | 54.4 | 56.8 | 54.6 |
| 210 | 54.6 | 56.3 | 54.5 | 54.5 | 56.7 | 54.7 |
| 240 | 54.3 | 56.1 | 54.5 | 54.5 | 56.5 | 54.7 |
| 300 | 54.4 | 56.3 | 53.9 | 53.9 | 56.3 | 54.2 |

TABLE 5

| Time | Pad Surface Temperature (° C.) | | | | | |
|---|---|---|---|---|---|---|
| (Seconds) | Ex. 11 | Ex. 12 | Ex 13 | Ex. 14 | Ex. 15 | CE-C |
| 0 | 29.7 | 28.8 | 29.7 | 28.9 | 28.4 | 30.5 |
| 10 | 40.6 | 34.9 | 34 | 35.8 | 34.6 | 36.3 |
| 20 | 46.3 | 37.4 | 38.3 | 38.4 | 37.1 | 42.1 |
| 30 | 50.1 | 41.5 | 41.6 | 41.3 | 38.4 | 44.3 |
| 40 | 53.4 | 44.1 | 43.1 | 46.2 | 39.8 | 47.7 |
| 50 | 55.1 | 46.1 | 45.6 | 47.7 | 42.8 | 49.4 |
| 60 | 55.9 | 48.1 | 48.1 | 50.9 | 45.1 | 49.9 |
| 70 | 56.3 | 48.6 | 48.8 | 52.1 | 46.8 | 51.4 |
| 80 | 56.6 | 49.9 | 49.3 | 53.1 | 48.3 | 52.1 |
| 90 | 56.6 | 50.6 | 49.6 | 53.8 | 48.8 | 52.6 |
| 100 | 56.8 | 51.1 | 49.9 | 54.3 | 50.1 | 52.9 |
| 110 | 56.9 | 52.1 | 50.6 | 54.5 | 50.9 | 53 |
| 120 | 56.9 | 52.6 | 51.2 | 54.6 | 51.5 | 53.2 |
| 150 | 56.8 | 53.1 | 52.2 | 54.8 | 52.3 | 53.6 |
| 180 | 56.8 | 53.3 | 52.6 | 55 | 53 | 53.7 |
| 210 | 56.9 | 53.4 | 53.2 | 54.8 | 53.2 | 53.8 |
| 240 | 56.6 | 53.4 | 53.4 | 54.7 | 53.1 | 53.6 |
| 300 | 56.4 | 53.3 | 52.9 | 54.3 | 53.1 | 53.7 |

TABLE 6

| Time | Pad Surface Temperature (° C.) | | | | | |
|---|---|---|---|---|---|---|
| (Seconds) | Ex. 16 | Ex. 17 | Ex 18 | Ex. 19 | Ex. 20 | CE-D |
| 0 | 28.8 | 28.4 | 29.3 | 27.1 | 27.5 | 31.3 |
| 10 | 32.1 | 33.6 | 32.8 | 30.9 | 34.5 | 36.9 |
| 20 | 34.5 | 37.3 | 37.2 | 32.9 | 36.1 | 39.8 |
| 30 | 36.4 | 38.8 | 40.7 | 36.9 | 38.3 | 40.8 |
| 40 | 37.4 | 42.1 | 43.6 | 37.8 | 38.8 | 43.2 |
| 50 | 40.1 | 42.6 | 46 | 38.5 | 39.8 | 43.8 |
| 60 | 45.1 | 44 | 47.4 | 39.3 | 42.3 | 45.2 |
| 70 | 46.4 | 44.8 | 48.1 | 40.6 | 43.8 | 45.7 |
| 80 | 47.4 | 45.4 | 48.4 | 41.6 | 48.7 | 47.1 |
| 90 | 48.1 | 46 | 48.5 | 44.3 | 50.6 | 47.7 |
| 100 | 48.8 | 46.6 | 48.9 | 48 | 50.9 | 48.3 |
| 110 | 49.2 | 47.6 | 49 | 49.6 | 51.4 | 48.7 |
| 120 | 49.7 | 46.6 | 49.3 | 50.1 | 52.5 | 49.4 |
| 150 | 50.8 | 47.7 | 49.4 | 52.4 | 53.2 | 50.3 |
| 180 | 51.6 | 47.8 | 49.7 | 52.8 | 53.6 | 50.8 |
| 210 | 51.8 | 49.2 | 50.4 | 53.3 | 53.8 | 51.3 |
| 240 | 52.4 | 51.3 | 50.9 | 53.7 | 53.6 | 51.6 |
| 300 | 52.7 | 52.1 | 53 | 53.7 | 53.6 | 51.9 |

What is claimed is:

1. A lapping pad comprising:

An abrading layer, wherein the abrading layer has a working surface, a second surface opposite the working surface having a projected area Ap, and at least one cavity having a cavity opening located at the second surface, the at least one cavity being defined by at least one rib, each rib having a distal end at the second surface; and a phase transition material having a thermally reversible phase transition, wherein the phase transition material is disposed in the at least one cavity; and wherein the total area of the cavity opening of the at least one cavity is between about 0.05Ap and about 0.995Ap; and wherein the at least one cavity is a plurality of cavities, the plurality of cavities having an areal density of between about 1 cavity/100 $cm^2$ of area Ap to about 5000 cavities/1 $cm^2$ of area Ap.

2. The lapping pad according to claim 1, wherein the abrading layer comprises from about 80 percent to about 100 percent by weight polymer.

3. The lapping pad according to claim 1, wherein the total area of the cavity opening of the at least one cavity is between about 0.10Ap and about 0.95Ap.

4. The lapping pad according to claim 1, wherein the thermally reversible phase transition is at least one of a melting point transition, a crystal to crystal transition, a liquid crystal to liquid crystal transition, a liquid crystal to liquid transition and a boiling point transition.

5. The lapping pad according to claim 1, wherein the phase transition material has a melting point between about 5° C. and about 80° C.

6. The lapping pad according to claim 1, wherein the enthalpy of the phase transition of the phase transition material is between about 100 J/g and about 400 J/g.

7. The lapping pad according to claim 1, wherein the phase transition material has a molecular weight of between about 100 g/mol and about 3000 g/mol.

8. The lapping pad according to claim 1, wherein the phase transition materials is at least one of a paraffin, paraffin wax, alcohol, ketone, ester, ether, fatty acid, vegetable oil, polyalkyl oxide and polyalkyl glycol.

9. The lapping pad according to claim 1, further comprising a sealing layer in contact with at least a portion of the second surface of the abrading layer.

10. The lapping pad according to claim 9, wherein the sealing layer comprises a first adhesive layer, having a first surface and a second surface, wherein the first surface of the first adhesive layer is adhered to the second surface of the abrading layer.

11. The lapping pad according to claim 10, wherein the sealing layer further comprises a polymer film having a first surface and a second surface, wherein the first surface of the polymer film is in contact with the second surface of the first adhesive layer.

12. The lapping pad according to claim 10, wherein the first adhesive layer is at least one of a pressure sensitive adhesive, a heat activated adhesive and a thermosetting adhesive.

13. The lapping pad according to claim 9, wherein the sealing layer is at least one of a single sided tape, a double sided tape and an adhesive transfer tape.

14. The lapping pad according to claim 1, wherein the lapping pad contains less than 5 percent by weight inorganic abrasive particles having a mohs hardness of 5.0 or greater.

15. A lapping system comprising a lapping pad according to claim 1 and a working fluid.

16. The lapping system according to claim 15, wherein the working fluid is a slurry.

17. A method of lapping a substrate comprising:

providing a lapping pad according to claim 1;

providing a substrate;

contacting the working surface of the lapping pad with the substrate surface; and moving the lapping pad and the substrate relative to one another while maintaining contact between the working surface of the lapping pad and the substrate surface; and wherein lapping is conducted in the presence of a working fluid.

18. The method of lapping a substrate according to claim 17, wherein the working fluid is a slurry.

19. The method of lapping a substrate according to claim 17, wherein the substrate is at least one of a sapphire substrate and a semiconductor wafer substrate.

20. A lapping pad comprising:

An abrading layer, wherein the abrading layer has a working surface, a second surface opposite the working surface having a projected area Ap, and at least one cavity having a cavity opening located at the second surface, the at least one cavity being defined by at least one rib, each rib having a distal end at the second surface; and a phase transition material having a thermally reversible phase transition, wherein the phase transition material is disposed in the at least one cavity; and a sealing layer in contact with at least a portion of the second surface of the abrading layer wherein the sealing layer comprises a first adhesive layer, having a first surface and a second surface, wherein the first surface of the first adhesive layer is adhered to the second surface of the abrading layer; and wherein the total area of the cavity opening of the at least one cavity is between about 0.05Ap and about 0.995Ap.

21. The lapping pad according to claim 20, wherein the sealing layer further comprises a polymer film having a first surface and a second surface, wherein the first surface of the polymer film is in contact with the second surface of the first adhesive layer.

22. The lapping pad according to claim 20, wherein the first adhesive layer is at least one of a pressure sensitive adhesive, a heat activated adhesive and a thermosetting adhesive.

23. The lapping pad according to claim 20, wherein the sealing layer is at least one of a single sided tape, a double sided tape and an adhesive transfer tape.

* * * * *